US010633060B2

(12) United States Patent
Milavski

(10) Patent No.: US 10,633,060 B2
(45) Date of Patent: Apr. 28, 2020

(54) TOOL DEVICE SYSTEM AND METHOD FOR WATERCRAFT FIN INSERTION AND REMOVAL

(71) Applicant: Fin Puller, Los Angeles, CA (US)

(72) Inventor: Gur Milavski, Los Angeles, CA (US)

(73) Assignee: FIN PULLER, Los Angeles, CA (US)

( * ) Notice: Subject to any disclaimer, the term of this patent is extended or adjusted under 35 U.S.C. 154(b) by 0 days.

(21) Appl. No.: 16/194,346

(22) Filed: Nov. 18, 2018

(65) Prior Publication Data

US 2019/0263485 A1 Aug. 29, 2019

Related U.S. Application Data

(60) Provisional application No. 62/636,174, filed on Feb. 28, 2018.

(51) Int. Cl.

| | |
|---|---|
| ***B63B 35/79*** | (2006.01) |
| ***B63B 35/85*** | (2006.01) |
| ***B25G 1/06*** | (2006.01) |
| ***B25G 1/10*** | (2006.01) |
| ***B63B 32/60*** | (2020.01) |
| ***B63B 32/66*** | (2020.01) |
| ***B63B 32/70*** | (2020.01) |
| *B63H 25/52* | (2006.01) |

(52) U.S. Cl.

CPC ..... *B63B 32/60* (2020.02); *B25G 1/06* (2013.01); *B25G 1/102* (2013.01); *B63B 32/66* (2020.02); *B63B 32/70* (2020.02); *B63H 25/52* (2013.01)

(58) Field of Classification Search

CPC ..... B63B 35/00; B63B 35/73; B63B 35/79; B63B 35/793; B63B 35/85; B63B 1/00; B63B 35/7926; B25B 27/00; B25B 27/14; B25F 1/00; B25G 1/00; B25G 1/06; B25G 1/102

USPC ..... 441/79

See application file for complete search history.

(56) References Cited

U.S. PATENT DOCUMENTS

| | | | | |
|---|---|---|---|---|
| 6,752,674 | B2 * | 6/2004 | Jolly | B63B 35/793 441/79 |
| 2003/0092334 | A1 * | 5/2003 | McCausland | B63B 35/793 441/79 |
| 2006/0019559 | A1 * | 1/2006 | Mair | B63B 35/793 441/79 |

FOREIGN PATENT DOCUMENTS

| | | | | |
|---|---|---|---|---|
| WO | WO 2018900151 | * | 1/2018 | B63B 35/793 |

* cited by examiner

*Primary Examiner* — Lars A Olson

(74) *Attorney, Agent, or Firm* — Vladimir Sherman; Professional Patent Solutions

(57) ABSTRACT

Disclosed is a tool for watercraft fin insertion and removal. The tool includes: a first external elongated layer, a second external elongated layer, aligned with, and positioned at a substantially parallel plane to the plane of, the first external layer. An internal layer is positioned between, and stretches across a portion of the area of, the external layers. Upon positioning the tool such that the inner surfaces of the external layers are adjacent to the outer surfaces of the watercraft fin, a curved fin engagement elements on the edge of the internal layer, complements at least a portion of the leading edge or the trailing edge of the watercraft fin.

15 Claims, 22 Drawing Sheets

TOOL DEVICE SYSTEM AND METHOD FOR WATERCRAFT FIN INSERTION AND REMOVAL

RELATED APPLICATIONS SECTION

The present application claims priority from applicant's U.S. Provisional Patent Application No. 62/636,174, which application is hereby incorporated by reference in its entirety.

FIELD OF THE INVENTION

The present invention generally relates to the field of water-borne vehicles, including recreational and watersports crafts, such as: sailboats, windsurfing boards, surfboards, paddle boards, kite boards, wake boards and the like. More specifically, the present invention relates to a tool, device, system and method for watercraft fin insertion and removal.

BACKGROUND

Most watercrafts, including surfboards, use fins for stability when the craft is moving. A surfboard fin, or skeg, is a hydrofoil mounted at the tail of a surfboard or similar board to improve directional stability and control through foot-steering. Fins can provide lateral lift opposed to the water and stabilize the board's trajectory, allowing the surfer to control direction by varying their side-to-side weight distribution. The introduction of fins in the 1930s revolutionized surfing and board design. Surfboard fins may be arrayed in different numbers and configurations, while many different shapes, sizes, and materials have been made and used.

A "skeg" (an upright, streamlined, often raked keel) typically denotes one centrally-mounted stabilizer foil mounted perpendicularly to the riding surface, at the rear of the surfboard.

Smaller surfboard fins mounted near the edge (or "rail") of the surfboard are known as "rail fins" and are seen in multi-fin arrangements (often in combination with a similarly-sized central fin further back on the board). Rail fins enable high-performance surfing, and are most often "single-foiled," with one flat side and one "foiled" side, as seen on an airfoil, for greater lift.

Both a skeg and "rail fins" stabilize the motion of the surfboard. They also contribute to the desired effect of converting the (kinetic energy) push of the sloped wave face combined with the rider's mass on the sloped wave face (potential energy) into redirected energy—lift—the surfer deflects his surfboard and fins off the water of the wave face (and/or vice versa) to make forward progress across the wave face, or "down the line," that is, parallel to the wave crest and beach—riding parallel to the crest (perpendicular to the pull of gravity down the wave's slope) in this way is known as "trimming" Lift (aka "drive") from the board and its fin(s) is what enables all maneuvers in surfing.

A fin configuration with fins near the edge of the board stabilizes and contributes lift during turning maneuvers, which contributes to the board's ability to "hold" during turning maneuvers. Rail fins are often seen in addition to a central fin, but can be used without a central fin as well. Some of the most popular multi-fin configurations use two rail fins (a "twin-fin"), two rail fins plus a similar sized central fin mounted further back (e.g. a "Thruster"), or four fins (a "quad"). Rail fins are more or less engaged by the rider's heel and toes as they lean in the desired direction of their turn. As the rider does so, an "inside" rail fin sinks deeper and its angle of attack is increased, as is its lift-induced drag. Rail fins also add lift (known as "drive") in trim and with greater holding ability, enable steeper wave faces to be ridden and higher speed "down the line."

In Windsurfing and other watercraft based sports, a derivative of traditional surfing, skegs may also be used as a central stabilizing fin (hydrofoil) located at the rear of the board. A windsurfer's skeg also has the effect of producing lift, which allows the rider to direct the craft laterally against the lift the sail (itself an airfoil) produces. The skeg has undergone numerous phases of development and, as with other foils, its design is determined by the balance of the pressures it experiences in use, including lift, drag (physics), ventilation and stall (flight).

Many types of fins have been developed for use with surfboards and other watercraft. Materials used for producing fins are normally Plastic or Fiber. Fiber fins combine different materials to obtain better performance, and better weight and flotation ratios like honeycomb cores or bamboo cores, and are then glassed with fiber and sometimes reinforced with carbon fiber.

Older model surfboards and watercrafts mainly used glass-on fins that are permanently connected to the craft or surfboard through fiberglass. Glass-on fins, however, are broken easily and are hard to repair. These types of fins are rarely used nowadays as different types of fins have replaced them.

Removable Fin Systems, are one of the most common types of fins used today.

Removable fins can be unscrewed, or otherwise disconnected, from the surfboard/craft and be replaced by different fins, or be moved about the board/craft for a different setup in maneuverability and stability.

In the early 90's three Australian surfers invented the Fin Control System (FCS). Since its global release in 1994 FCS has become an industry standard; providing elite athletes and everyday surfers an abundance of fin designs and a platform to change the performance of their surfboard by changing fins. The system also streamlined the surfboard manufacturing process by making it easier to install fins into boards and repair damaged fins. One of the leading competitors to FCS fins is Futures fins. Using a single larger fin box, the manufacture claims the fins provide a stronger connection and more closely approximate the feeling of a glass-on fin.

However, severe problems often arise when extracting/removing or inserting fins from their fin boxes, for example when there is a need to replace them or take them off on the go. It is very hard, sometimes almost impossible, for an adult, let alone a child—as watercraft and water-board sports cater to all ages and genders—to extract and insert the fin by the hand. The problem is intensified by the fact that the fins are mostly used in water sports which involve salt water, sand and dust that tend to clog the fin in the fin box. In addition, the fin itself often gets scratched up and dented, which altogether makes removing and inserting a fin a very challenging task to achieve, without hurting yourself, or damaging: your watercraft, the fin and/or the fin box, during the process.

There remains a need, in the field of water-borne vehicles and watercrafts, for solutions, improved methodologies and tools, for inserting and removing fins—of various kinds of removable fin systems—from corresponding fin-box(es)/ socket(s)/slot(s) of a watercraft, such as, but not limited to: surfboards, wakeboards, paddle boards and/or others.

SUMMARY OF THE INVENTION

The present invention includes a tool, device, system and methods for watercraft fin insertion and removal. A tool, in accordance with some embodiments, may be a handheld lever-type torque generating tool. The present invention may also include removable fin systems including a handheld lever-type torque generating tool.

According to embodiments of the present invention, the tool may include a gripping/handle portion toward the end of a first side of the tool. Towards the end of a second side of the tool, there may be included one or more leverage point catches. At one or more points on the tool, in between the leverage point catch(es) (also referred to as 'fin box engagement section' herein) and the grip/handle, the tool may include one or more fin engagement elements adapted to convey to the fin a force applied to the tool by a user through the grip/handle portion.

The force conveyed to the fin may be a removing or binding-disengagement force. Alternatively, the force conveyed to the fin may be an inserting or binding-engagement force. According to some embodiments, the same fin engagement element may be used to convey both the fin removing and the fin inserting forces, while according to other embodiments, a separate fin engagement element may be used to convey the inserting force and to convey the removing force. According to yet further embodiments of the present invention, different surfaces of the same engagement element may be used for applying engagement and disengagement forces.

According to yet furthermore embodiments, the handheld lever-type torque generating tool may be formed with only one sheet/layer of rigid material, one or more fin engagement elements and one or more leverage point catching elements connected to the one sheet/layer of rigid material.

According to some embodiments, the tool may be formed by two parallel but spaced apart sheets/layers (also referred to as 'external layers' herein) of rigid material with a space or open area in between the sheets/layers. The open area may be configured to receive a fin which is to be inserted or removed from a watercraft or surfboard. The sheets/layers may be interconnected to one another by one or more interconnection elements, one or more of which interconnection elements may be a fin engagement element, or a middle sheet/layer (also referred to as 'internal layer' herein).

A leverage point catch, according to embodiments of the present invention may be formed by an edge of one or both of the sheets/layers and/or by one of the sheet interconnection element(s), for example the middle/internal sheet/layer, holding the two sheets/layers together at some separation distance.

A tool for watercraft fin insertion and removal, in accordance with some embodiments, may include an elongated first external layer and a substantially similar second external layer aligned therewith. An internal layer may stretch across the area of a first side of the elongated external layers, positioned and connecting between them.

The outer edge of the internal layer may run along the edges of the external layers, wherein the edge of the ending line of the area covered by the internal layer—at or around the central section of the elongated external layers—includes one or more Fin Engagement Elements (which may also be interchangeably referred to herein, as 'Curved Fin Engagement Element(s)') to accommodate the leading edge and/or the trailing edge of the watercraft fin.

The bottom line of the tool, may widen at the second side of the elongated external layers, to form a wide curved Fin Box Engagement section.

According to some embodiments, positioning the wide curved fin box engagement section on the bottom of the watercraft, or a fin box thereof, at a first angle with the bottom of the watercraft, while the inner surfaces of the external layers are adjacent-to/overlap-with/cover at least part of the outer side surfaces of a fin to be inserted—may position a first fin engagement element of the internal layer, on the leading edge of the fin.

Applying downward force (in the general direction of the bottom of the watercraft) on the top of the first side of the elongated external layers—while also applying downward force (in the general direction of the bottom of the watercraft) on the top of the second side of the elongated external layers and thus retaining the position of the wide curved fin box engagement section—may cause the first fin engagement element of the internal layer to push against the leading edge of the fin, creating backwards and downwards force on the fin while inserting it into its position in the bottom of the watercraft or a fin box integrated thereto.

According to some embodiments, positioning the wide curved fin box engagement section on the bottom of the watercraft, or a fin box thereof, at a second, sharper, angle with the bottom of the watercraft, while the inner surfaces of the external layers are adjacent-to/overlap-with/cover at least part of the outer side surfaces of a fin to be inserted—may position a second fin engagement element of the internal layer, on the trailing edge of the fin.

Applying upward force (in the general direction of up and away from the bottom of the watercraft) on the first side of the tool—while also applying downward force (in the general direction of the bottom of the watercraft) on the top of the second side of the tool and thus retaining the wide curved fin box engagement section in contact with the bottom of the watercraft or fin box thereof—may cause the second fin engagement element of the internal layer to push against the trailing edge of the fin, creating forward and upwards force on the fin while removing it from its position in the bottom of the water craft or a fin box integrated thereto.

The elongated shape of the described tool, may accordingly leverage, while increasing the effort of, forces applied onto the first side of the elongated external layers, wherein the wide curved fin box engagement section, on the second, opposite, side of the tool, acts as an axis to the formed lever. The leveraged forces, transformed by the fin engagement elements of the internal layer to the fin itself, are utilized by the tool for enabling/improved/easier fin insertion and removal/extraction.

According to some embodiments, the edges of the fin engagement elements of the internal layer, the edge of the wide curved fin box engagement section and/or at least part of the inner facing surfaces of the external layers—may be covered by a non-slip material for better grabbing/holding-onto the inserted/removed fin and/or the bottom of the watercraft or a fin box integrated thereto.

The non-slip material used, in accordance with some embodiments, may be a substantially soft, protective and/or cushioning material, for preventing damage—to the watercraft, the fin box, or the fin itself—from the contact surfaces/areas/lines/points of the fin insertion and removal tool, coming in contact therewith and/or applying forces thereon.

According to some embodiments, the fin insertion and removal tool may be produced/fabricated: as separate external layers and an internal layer, connected (e.g. glued, screwed, clipped) to each other; as a single molded unit; as a single unit curved/cut-out from a piece of material (e.g. by a router, by a drill); as a 3-dimensional printed unit or 3-dimensionally printed parts connected to each other; and/or by utilizing any other production/fabrication method or process, known today or to be devised in the future.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings:

Figure 1A:
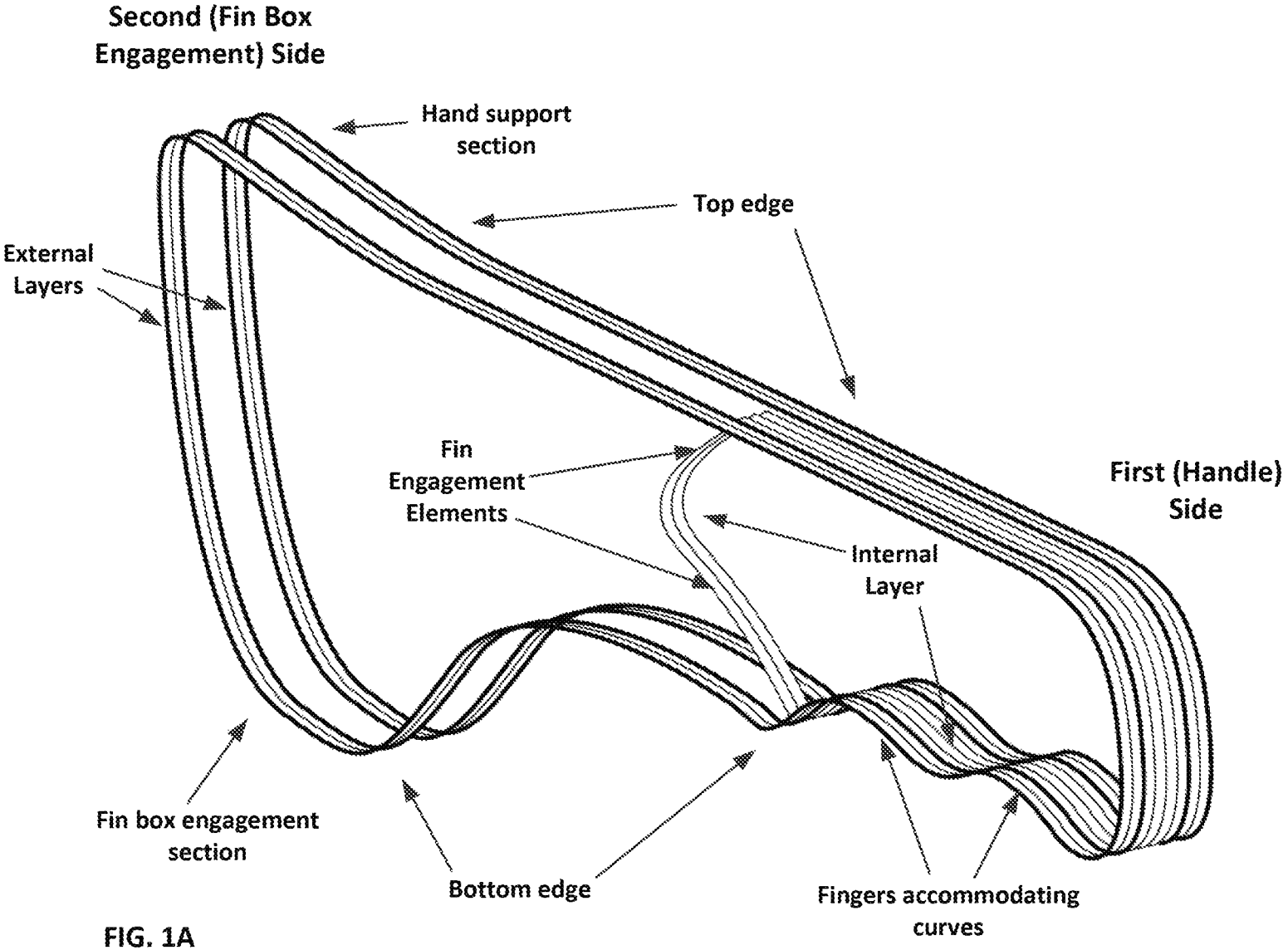
FIG. 1A is a perspective transparent/see-through view diagram of an exemplary tool for watercraft fin insertion and removal, in accordance with some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Functions, operations, components and/or features described herein with reference to one or more embodiments, may be combined with, or may be utilized in combination with, one or more other functions, operations, components and/or features described herein with reference to one or more other embodiments.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "includes", "including", "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention, and is not intended to limit the invention to the specific embodiments illustrated by the figures or description below.

According to some embodiments of the present invention, there may be provided a tool, device, system and method for watercraft fin insertion and removal.

A tool for watercraft fin insertion and removal, in accordance with some embodiments, may include an elongated first external layer and a substantially similar second external layer aligned therewith. An internal layer may stretch across the area of a first side of the elongated external layers, positioned and connecting between them.

The outer edge of the internal layer may run along the edges of the external layers, wherein the edge of the ending line of the area covered by the internal layer—at or around the central section of the elongated external layers—includes one or more Fin Engagement Elements (which may also be interchangeably referred to herein, as 'Curved Fin Engagement Element(s)') to accommodate the leading edge and/or the trailing edge of the watercraft fin.

The bottom line of the tool, may widen at the second side of the elongated external layers, to form a wide curved Fin Box Engagement section.

In FIG. 1A, there is shown a perspective transparent/see-through view diagram of an exemplary tool for watercraft fin insertion and removal, in accordance with some embodiments of the present invention.

In the figure, the top and bottom edges of the tool are shown. Further shown are the first side and second side of the tool, and its external layers. The internal layer of the tool is shown to end substantially at the center section of the tool, forming two curved fin engagement elements.

On the first side of the tool, the layers of the tool are shown to have fingers accommodating curves, on the bottom edge, forming a grip/handle section of the tool for the first hand of a user. On the second side of the tool, the external layers are shown to widen at the bottom edge of the tool, forming a wide curved fin box engagement section having a leverage point/section/axis on its edge. Also, on the second side of the tool, the external layers are shown to have a slight indent/curve at the top edge of the tool, forming a hand support section for the second hand of a user.

Figure 1B:
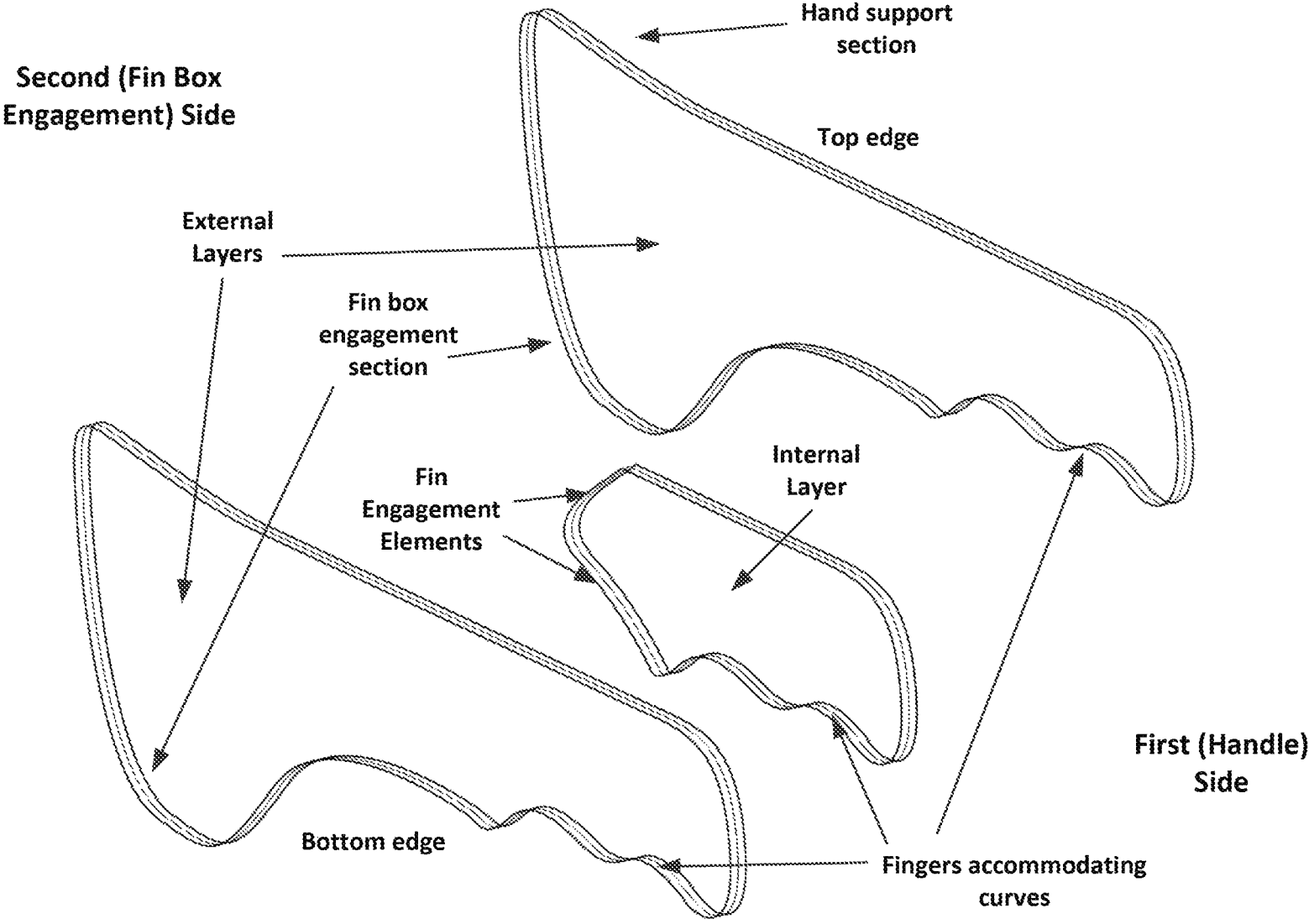
FIG. 1B is a perspective exploded view diagram of an exemplary tool for watercraft fin insertion and removal, in accordance with some embodiments of the present invention.

In FIG. 1B, there is shown a perspective exploded view diagram of an exemplary tool for watercraft fin insertion and removal, in accordance with some embodiments of the present invention.

In the figure, the external layers and the internal layer of the tool are separately shown. The internal layer is shown to be shorter and end substantially at the center section of the tool, forming two curved fin engagement elements.

On the first side of the tool, the layers of the tool are shown to have fingers accommodating curves, on the bottom edge, forming a grip/handle section of the tool for the first hand of a user. On the second side of the tool, the external layers are shown to widen at their bottom edges, forming a wide curved fin box engagement section having a leverage point/section/axis on its edge. Also, on the second side of the tool, the external layers are shown to have a slight indent/curve at the top edge of the tool, forming a hand support section for the second hand of a user.

Figure 2A:
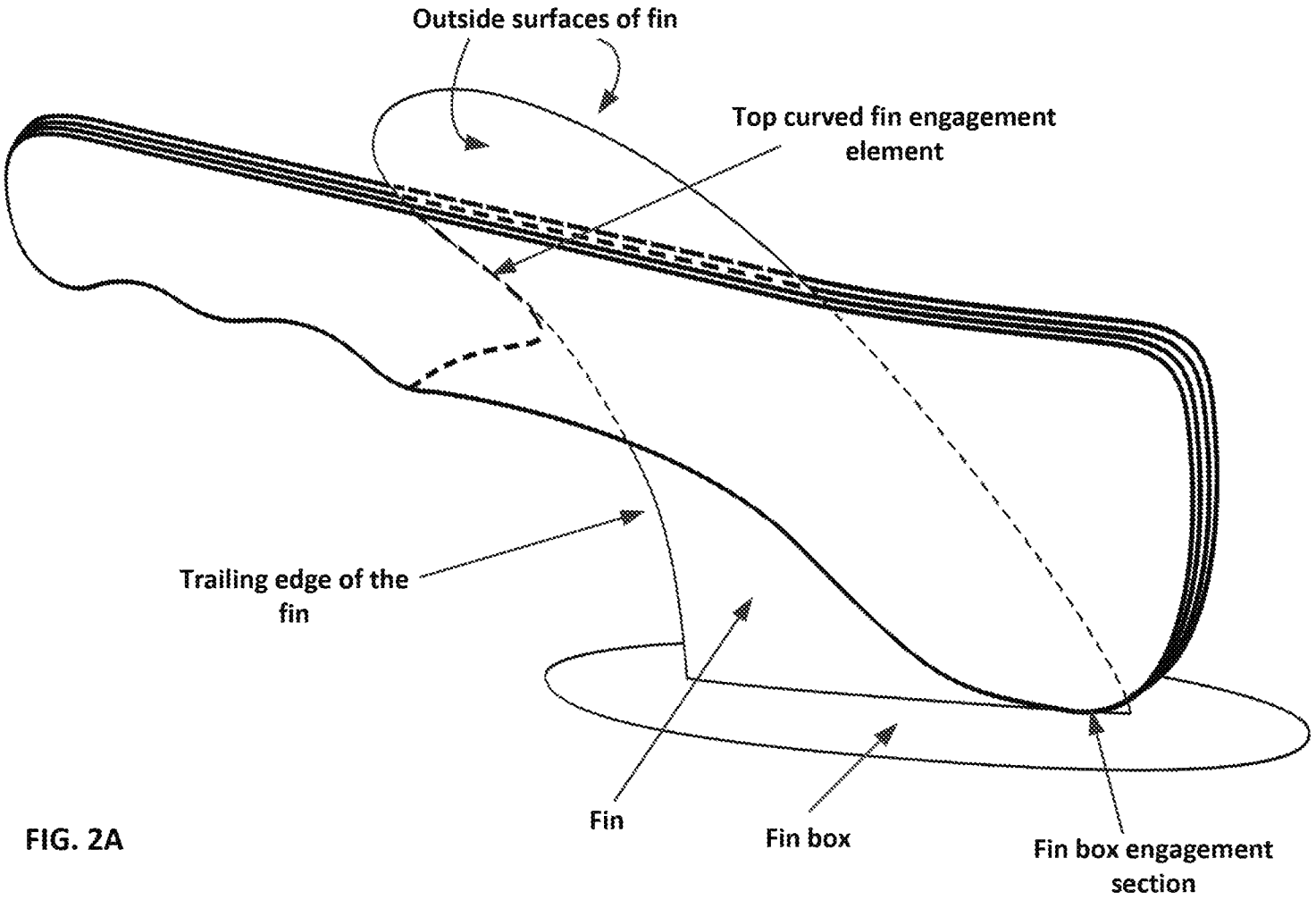
FIG. 2A is a perspective view diagram of an exemplary tool for watercraft fin insertion and removal, in accordance with some embodiments of the present invention, wherein the tool is shown, along with a watercraft fin and a fin box thereof, in a fin removal position.

In FIG. 2A, there is shown a perspective view diagram of an exemplary tool for watercraft fin insertion and removal, in accordance with some embodiments of the present invention, wherein the tool is shown, along with a watercraft fin and a fin box thereof, in a fin removal position.

The inner surfaces of the external layers of the tools are shown to be adjacent-to/partially-overlapping the outside surfaces of the shown fin. The leverage point/section/axis on the edge of the wide curved fin box engagement section is shown to be positioned-on/in-contact-with the fin box of the fin, while a top curved fin engagement element is in contact with trailing edge of the fin.

Figure 2B:
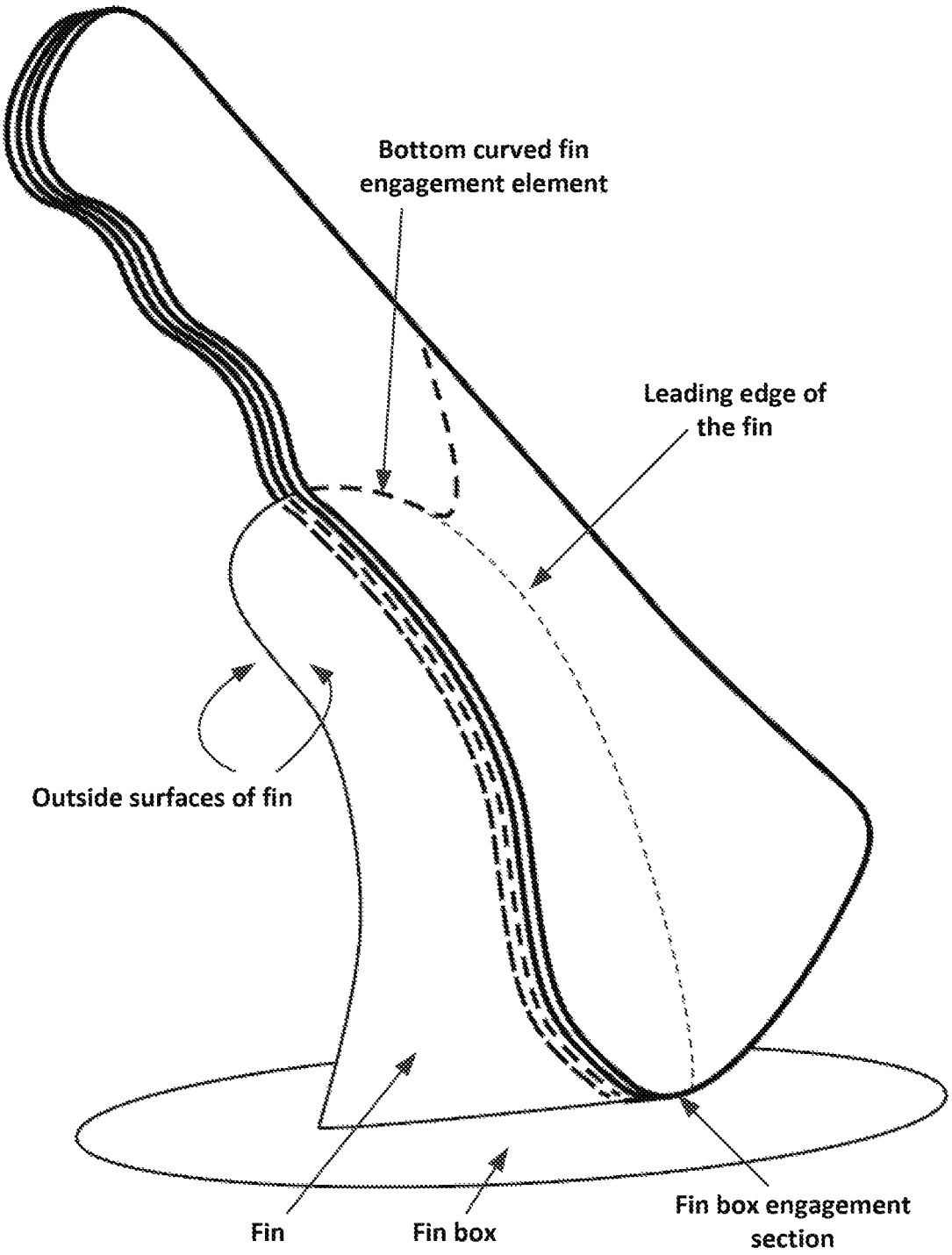
FIG. 2B is a perspective view diagram of an exemplary tool for watercraft fin insertion and removal, in accordance with some embodiments of the present invention, wherein the tool is shown, along with a watercraft fin and a fin box thereof, in a fin insertion position.

In FIG. 2B, there is shown, a perspective view diagram of an exemplary tool for watercraft fin insertion and removal, in accordance with some embodiments of the present invention, wherein the tool is shown, along with a watercraft fin and a fin box thereof, in a fin insertion position.

The inner surfaces of the external layers of the tools are shown to be adjacent-to/partially-overlapping the outside surfaces of the shown fin. The leverage point/section/axis on the edge of the wide curved fin box engagement section is shown to be positioned-on/in-contact-with the fin box of the fin, while a bottom curved fin engagement element is in contact with leading edge of the fin.

According to some embodiments, positioning the wide curved fin box engagement section on the bottom of the watercraft, or a fin box thereof, at a first angle with the bottom of the watercraft, while the inner surfaces of the external layers are adjacent-to/overlap-with/cover at least part of the outer side surfaces of a fin to be inserted—may position a first curved fin engagement element of the internal layer, on the leading edge of the fin.

Applying downward force (in the general direction of the bottom of the watercraft) on the top of the first side of the elongated external layers—while also applying downward force (in the general direction of the bottom of the watercraft) on the top of the second side of the elongated external layers and thus retaining the position of the wide curved fin box engagement section—may cause the first curved fin engagement element of the internal layer to push against the leading edge of the fin, creating backwards and downwards force on the fin while inserting it into its position in the bottom of the watercraft or a fin box integrated thereto.

According to some embodiments, positioning the wide curved fin box engagement section on the bottom of the watercraft, or a fin box thereof, at a second, sharper, angle with the bottom of the watercraft, while the inner surfaces of the external layers are adjacent-to/overlap-with/cover at least part of the outer side surfaces of a fin to be inserted—may position a second curved fin engagement element of the internal layer, on the trailing edge of the fin.

Applying upward force (in the general direction of up and away from the bottom of the watercraft) on the first side of the tool—while also applying downward force (in the general direction of the bottom of the watercraft) on the top of the second side of the tool and thus retaining the wide curved fin box engagement section in contact with the bottom of the watercraft or fin box thereof—may cause the second curved fin engagement element of the internal layer to push against the trailing edge of the fin, creating forward and upwards force on the fin while removing it from its position in the bottom of the water craft or a fin box integrated thereto.

The elongated shape of the described tool, may accordingly leverage, while increasing the effort of, forces applied onto the first side of the elongated external layers, wherein the wide curved fin box engagement section, on the second, opposite, side of the tool, acts as an axis to the formed lever. The leveraged forces, transformed by the curved fin engagement elements of the internal layer to the fin itself, are utilized by the tool for enabling/improved/easier fin insertion and removal/extraction.

Figure 3A:
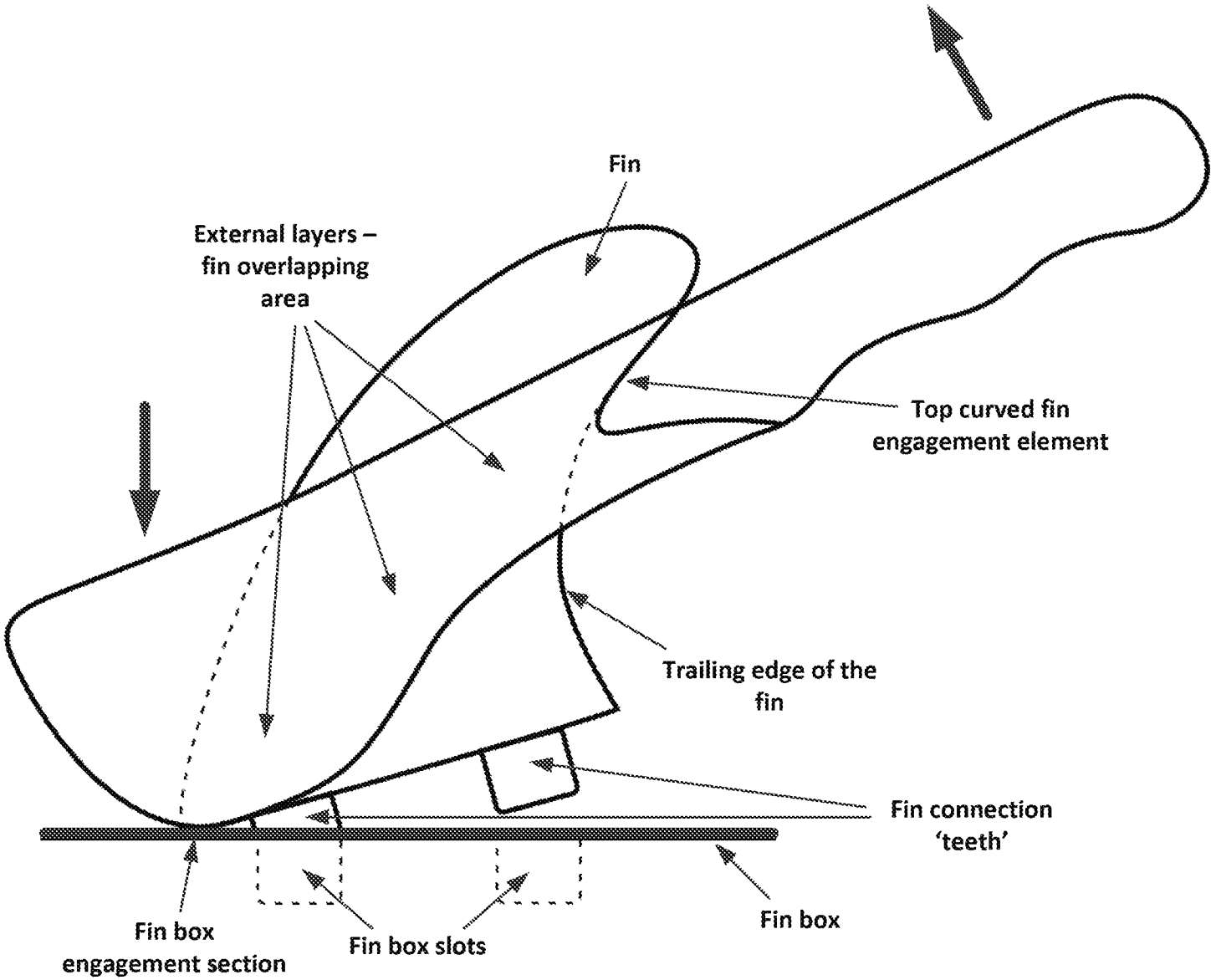
FIG. 3A is a side view diagram of an exemplary tool for watercraft fin insertion and removal, in accordance with some embodiments of the present invention, wherein the tool is shown in a fin removal position.

In FIG. 3A, there is shown, a side view diagram of an exemplary tool for watercraft fin insertion and removal, in accordance with some embodiments of the present invention, wherein the tool is shown in a fin removal position.

As described in regard to FIG. 2A, the inner surfaces of the external layers of the tool are shown to be adjacent-to/partially-overlapping the outside surfaces of the shown fin. The leverage point/section/axis on the edge of the wide curved fin box engagement section is shown to be positioned-on/in-contact-with the fin box of the fin, while the top curved fin engagement element is in contact with trailing edge of the fin.

Applying upward force on the first, handle side of the tool, in the direction of the upward facing arrow, while simultaneously applying downward force/pressure on the top of the second, fin box engagement section, side of the tool, will cause the tool to turn up and around the leverage point/section/axis on the edge of the wide curved fin box engagement section. The upward force is transferred by the top curved fin engagement element to the trailing edge of the fin, causing its back, trailing edge, side to be withdrawn from the fin box as the tool turns up and around the leverage point/section/axis.

In this example, the fin is shown to have two fin connection 'teeth' structured to fit into, or be withdrawn from, two respective fin box slots, thereby interconnecting/disconnecting between the fin and fin box.

Figure 3B:
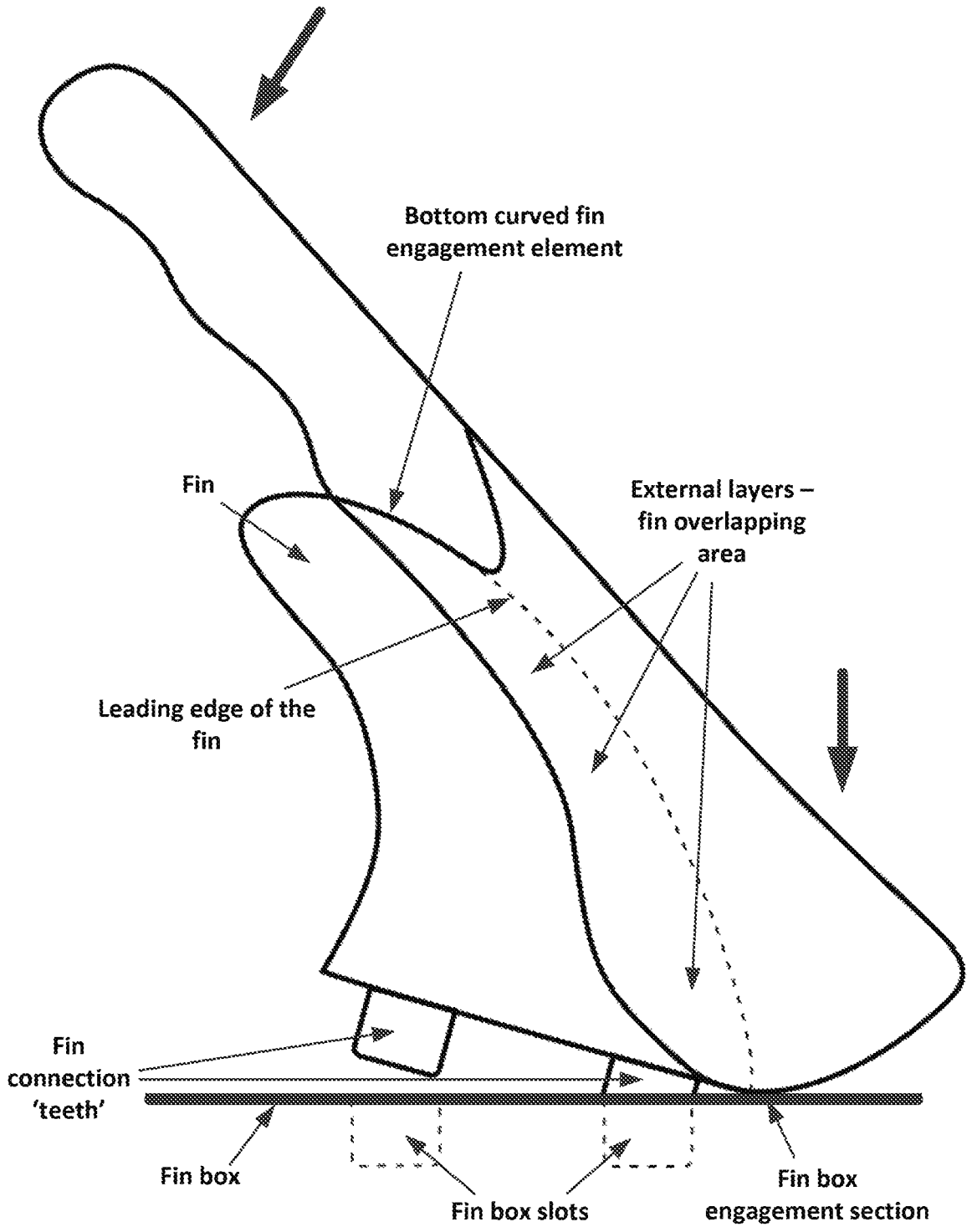
FIG. 3B is a side view diagram of an exemplary tool for watercraft fin insertion and removal, in accordance with some embodiments of the present invention, wherein the tool is shown in a fin insertion position.

In FIG. 3B, there is shown, a side view diagram of an exemplary tool for watercraft fin insertion and removal, in accordance with some embodiments of the present invention, wherein the tool is shown in a fin insertion position.

As described in regard to FIG. 2B, the inner surfaces of the external layers of the tool are shown to be adjacent-to/partially-overlapping the outside surfaces of the shown fin. The leverage point/section/axis on the edge of the wide curved fin box engagement section is shown to be positioned-on/in-contact-with the fin box of the fin, while the bottom curved fin engagement element is in contact with leading edge of the fin.

Applying downward force on the first, handle side of the tool, in the direction of the downward facing arrow, while simultaneously applying downward force/pressure on the top of the second, fin box engagement section, side of the tool, will cause the tool to turn down and around the leverage point/section/axis on the edge of the wide curved fin box engagement section. The downward force is transferred by the bottom curved fin engagement element to the leading edge of the fin, causing its back, trailing edge, side to be inserted into the fin box as the tool turns down and around the leverage point/section/axis.

In this example, the fin is shown to have two fin connection 'teeth' structured to fit into, or be withdrawn from, two respective fin box slots, thereby interconnecting/disconnecting between the fin and fin box.

According to some embodiments, the edges of the curved fin engagement elements of the internal layer, the edge of the wide curved fin box engagement section and/or at least part of the inner facing surfaces of the external layers—may be covered by a non-slip material for better grabbing/holding-onto the inserted/removed fin and/or the bottom of the watercraft or a fin box integrated thereto.

The non-slip material used, in accordance with some embodiments, may be a substantially soft, protective and/or cushioning material, for preventing damage—to the watercraft, the fin box, or the fin itself—from the contact surfaces/areas/lines/points of the fin insertion and removal tool, coming in contact therewith and/or applying forces thereon.

According to some embodiments, the non-slip material may comprise of an elastic substance or material, such as, but not limited to: rubber, natural-rubber/caoutchouc, plastic or polymer, leather, cotton, polyester, epoxy, sponge and/or any other soft, elastic, cushioning or protective material, known today, or to be devised in the future.

According to some embodiments, the non-slip material, or pieces/straps thereof, may be connected to the tool by: glue or adhesive material, pins or clips, channels/holes into which part of the material is molded, adhesive properties of the non-slip material itself and/or any other connection method, known today, or to be devised in the future.

Figure 4A:
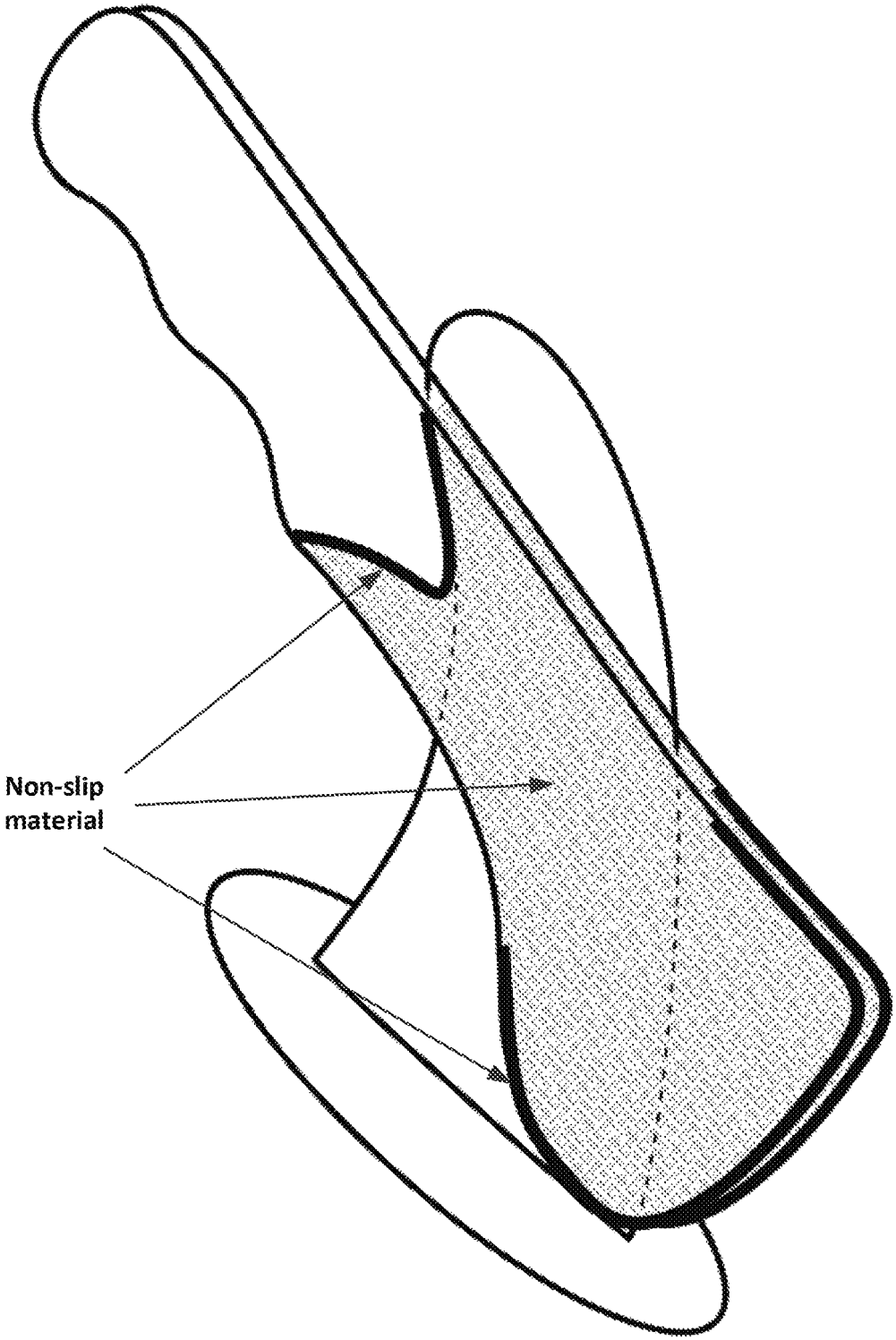
FIG. 4A is a perspective view diagram of an exemplary tool for watercraft fin insertion and removal, in accordance with some embodiments of the present invention, wherein the tool includes non-slip covered edges/areas and is shown, along with a watercraft fin and a fin box thereof, in a fin removal position.

In FIG. 4A, there is shown, a perspective view diagram of an exemplary tool for watercraft fin insertion and removal, in accordance with some embodiments of the present invention, wherein the tool includes non-slip covered edges/areas and is shown, along with a watercraft fin and a fin box thereof, in a fin removal position.

The edges of the top curved fin engagement element of the internal layer, the edge of the wide curved fin box engagement section and the inner facing surfaces of the external layers—are shown to be covered by a non-slip material for better grabbing/holding-onto the removed fin and/or the fin box.

Figure 4B:
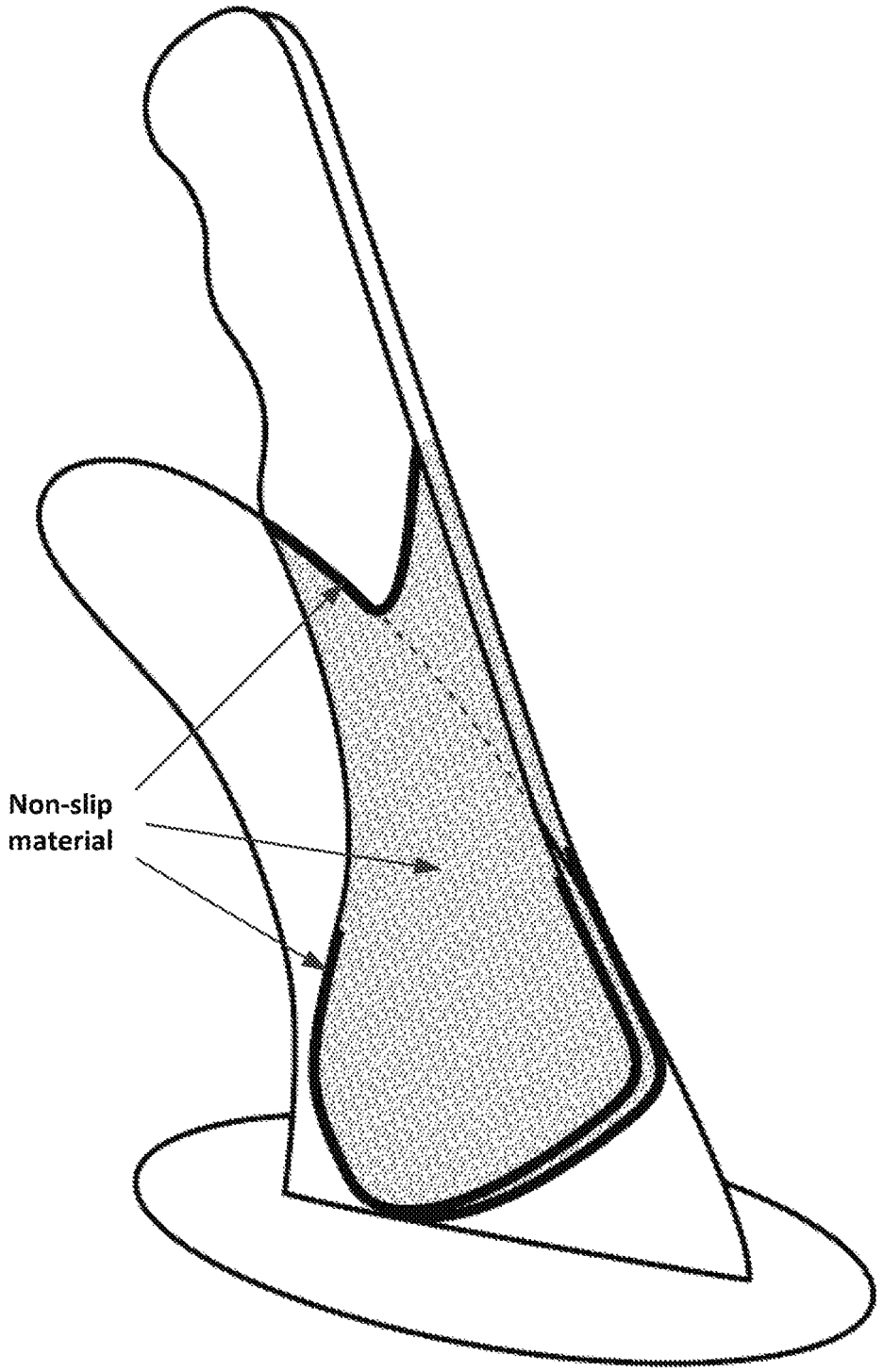
FIG. 4B is a perspective view diagram of an exemplary tool for watercraft fin insertion and removal, in accordance with some embodiments of the present invention, wherein the tool includes non-slip covered edges/areas and is shown, along with a watercraft fin and a fin box thereof, in a fin insertion position.

The non-slip material prevents damage—to the watercraft, the fin box, or the fin itself—from the contact surfaces/areas/lines/points of the fin insertion and removal tool, coming in contact therewith and/or applying forces thereon. The In FIG. 4B, there is shown, a perspective view diagram of an exemplary tool for watercraft fin insertion and removal, in accordance with some embodiments of the present invention, wherein the tool includes non-slip covered edges/areas and is shown, along with a watercraft fin and a fin box thereof, in a fin insertion position.

The edges of the bottom curved fin engagement element of the internal layer, the edge of the wide curved fin box engagement section and the inner facing surfaces of the external layers—are shown to be covered by a non-slip material for better grabbing/holding-onto the inserted fin and/or the fin box.

The non-slip material prevents damage—to the watercraft, the fin box, or the fin itself—from the contact surfaces/areas/lines/points of the fin insertion and removal tool, coming in contact therewith and/or applying forces thereon.

Figure 5A:
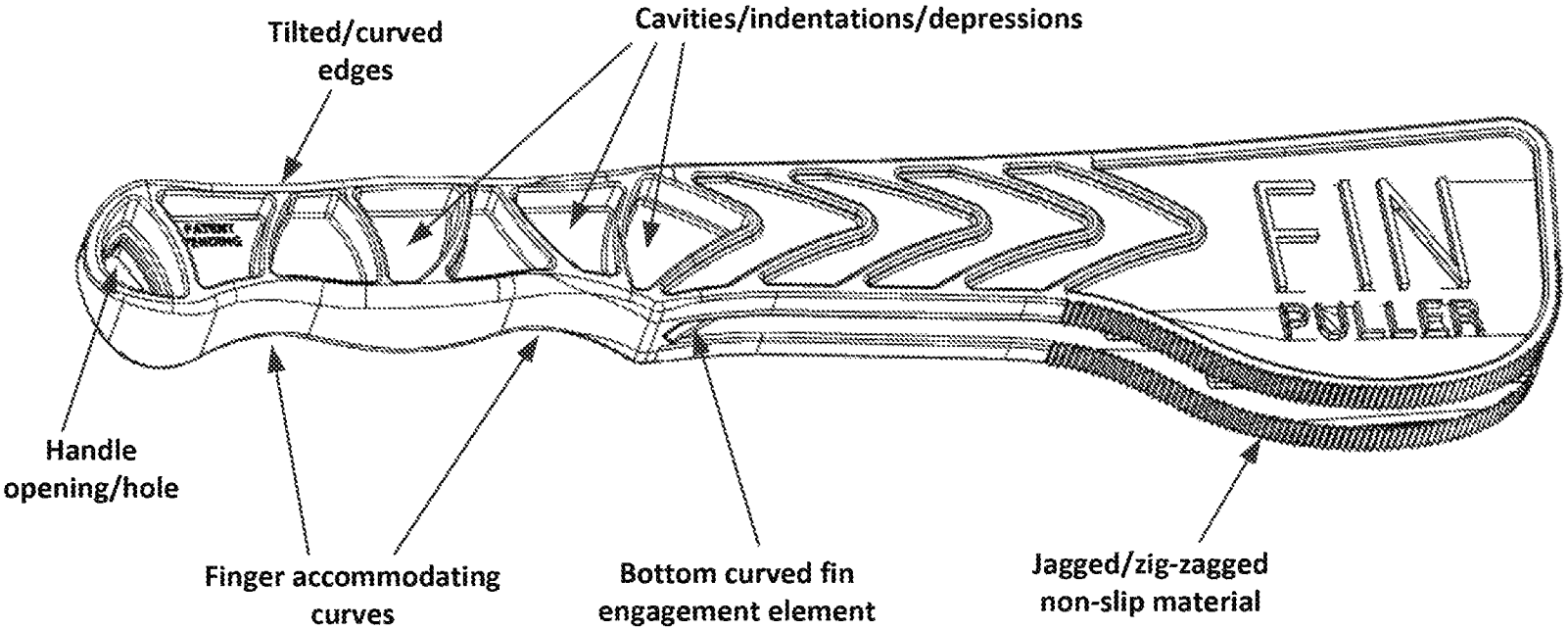
FIGS. 5A-5F are diagrams of an exemplary tool for watercraft fin insertion and removal, in accordance with some embodiments of the present invention, wherein the tool is shown in: a perspective view (FIG. 5A), a side view (FIG. 5B), a top view (FIG. 5C), a bottom view (FIG. 5D), a back/handle-side view (FIG. 5E) and a front/fin-box-engagement-side view (FIG. 5F)
Figure 5B:
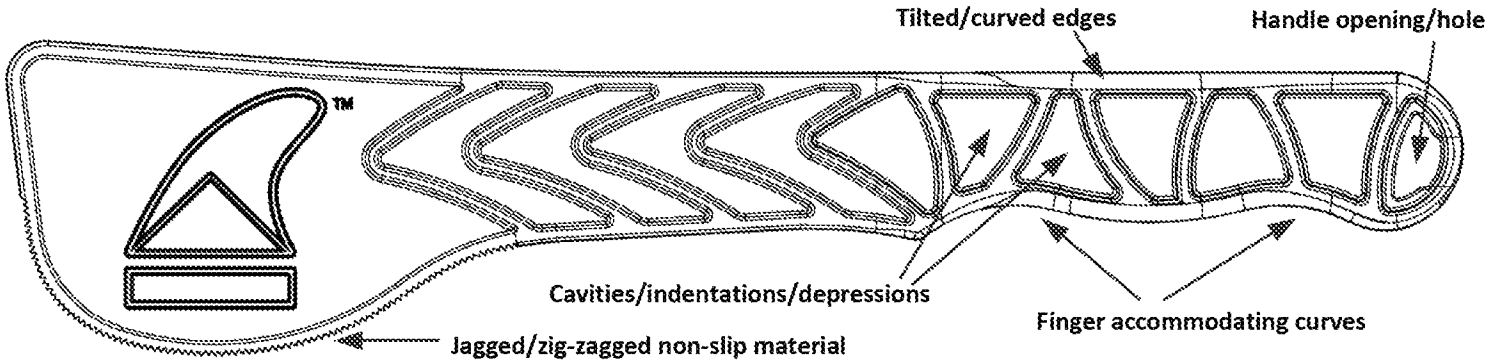
Figure 5C:
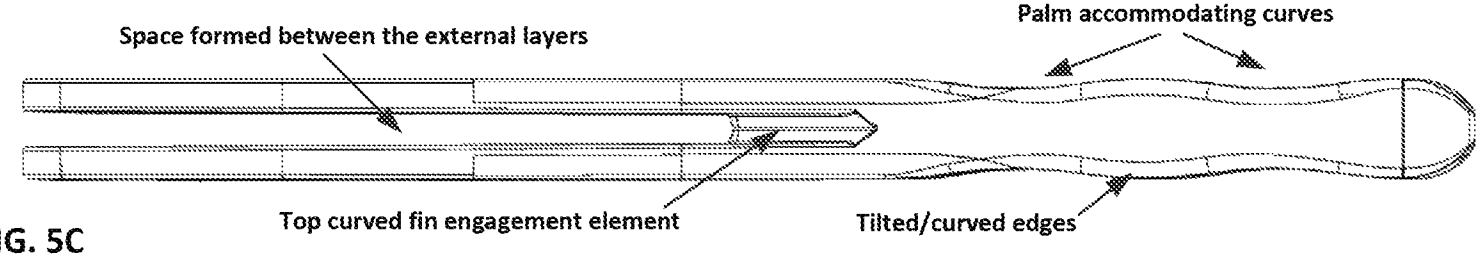
Figure 5D:
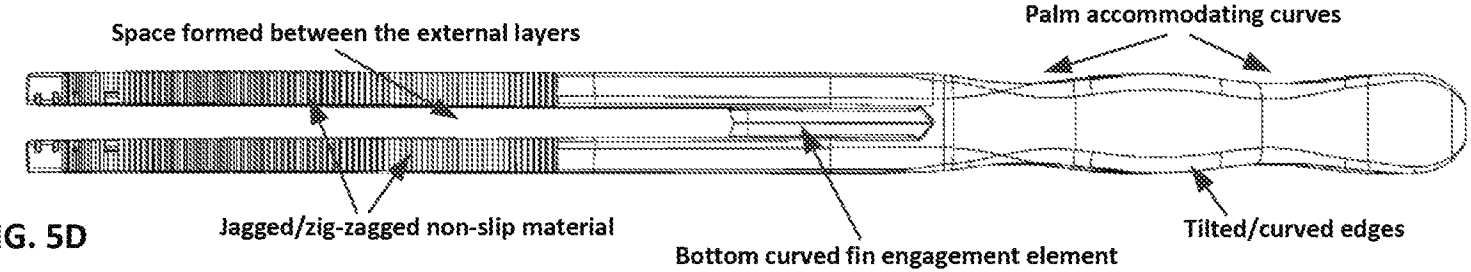
Figure 5F:
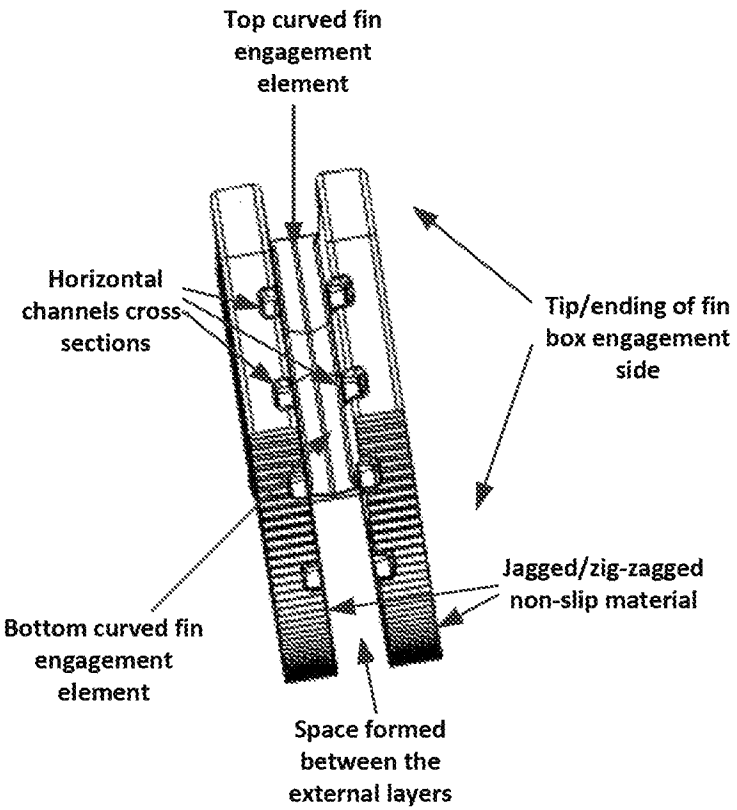

In FIGS. 5A-5F, there are shown, diagrams of an exemplary tool for watercraft fin insertion and removal, in accordance with some embodiments of the present invention, wherein the tool is shown in: a perspective view (FIG. 5A), a side view (FIG. 5B), a top view (FIG. 5C), a bottom view (FIG. 5D), a back/handle-side view (FIG. 5E) and a front/fin-engagement-side view (FIG. 5F).

In FIG. 5A the tool is shown in a perspective view. The first, handle side, is shown to include finger accommodating curves on its bottom edges and slightly tilted/curved edges on its top edges to form a gripping section for the hand of a user. Further shown is an opening or hole at the tip of the handle for connecting a strap/rope and/or for hanging the device. The handle side, on the outer surfaces of its external layer, includes cavities/indentations/depressions to lower the weight of the tool and/or improve its grip. At the bottom edge of the tool, the internal layer is shown to end forming the fin engagement elements, wherein part of the bottom curved fin engagement element can be seen between the external layers.

The second, fin engagement side, is show to include non-slip material strips running along the edges of the external layers, at the bottom, end, and top of their widening end sections. Part of the non-slip material strips, in this exemplary embodiment, are shown to have jagged/zig-zagged edges to improve their grip and/or cushioning when pressed against the fin box of a fin being removed or inserted.

In FIG. 5B the tool is shown in a side view. The first, handle side, is shown to include finger accommodating curves on its bottom edges and slightly tilted/curved edges on its top edges to form a gripping section for the hand of a user. Further shown is an opening or hole at the tip of the handle for connecting a strap/rope and/or for hanging the device. The handle side, on the outer surfaces of its external layer, includes lower cavities/indentations/depressions to lower the weight of the tool and/or improve its grip.

The second, fin engagement side, is show to include non-slip material strips running along the edges of the external layers, at the bottom, end, and top of their widening end sections. The bottom part, and part of the end part, of the non-slip material strips, in this exemplary embodiment, are shown to have jagged/zig-zagged edges to improve their grip and/or cushioning when pressed against the fin box of a fin being removed or inserted.

In FIG. 5C the tool is shown in a top view. The first, handle side, is shown to include palm accommodating curves on the outer sides/surfaces of the external layers, and slightly tilted/curved edges on its top edges, to form a gripping section for the hand of a user. The space formed between the external layers, to accommodate/accept a fin being removed/inserted, is also indicated, along with the top curved fin engagement element—formed by the internal layer—at the starting end of the space, approximately at middle or center of the tool.

In FIG. 5D the tool is shown in a bottom view. The first, handle side, is shown to include palm accommodating curves on the outer sides/surfaces of the external layers, and slightly tilted/curved edges on its bottom edges, to form a gripping section for the hand of a user. The space formed between the external layers, to accommodate/accept a fin being removed/inserted, is also indicated, along with the bottom curved fin engagement element—formed by the internal layer—at the starting end of the space, approximately at middle or center of the tool.

Further shown are the non-slip material strips running along the edges of the external layers, at the bottom of their widening end sections. The bottom part of the non-slip material strips, are shown to have jagged/zig-zagged edges—depicted by the multiple short parallel lines drawn across the edges—to improve their grip and/or cushioning when pressed against the fin box of a fin being removed or inserted.

Figure 5E:
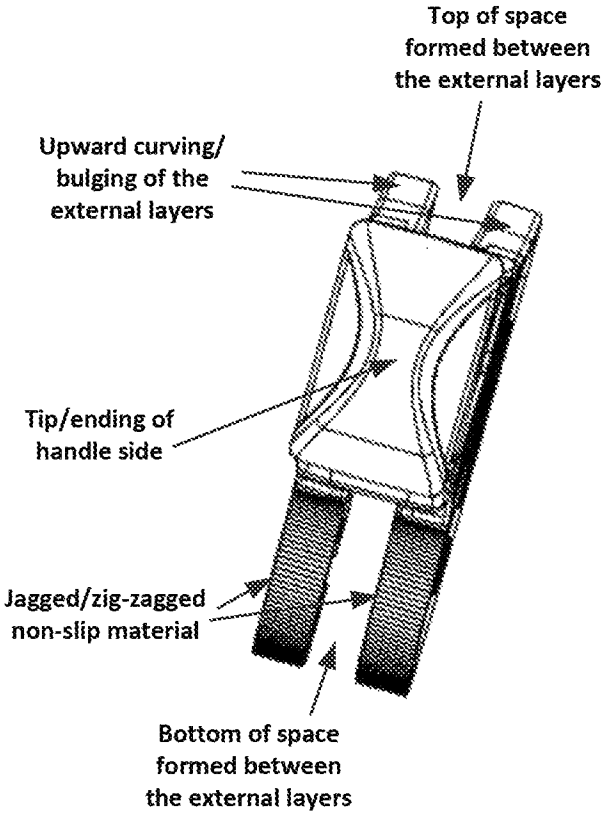

In FIG. 5E the tool is shown in a back/handle-side view. The tip/ending of the first, handle side, is shown in the figure. On the widening end sections of the edges of the external layers, the handle-facing bottom part of the non-slip material strips are shown to have jagged/zig-zagged edges—depicted by the multiple short parallel lines drawn across the edges—to improve their grip and/or cushioning when pressed against the fin box of a fin being removed or inserted. The bottom of the space formed between the external layers, to accommodate/accept a fin being removed/inserted, is also indicated.

Further shown, is the upward curving/bulging/protruding of the external layers at the top of the second, fin box engagement side, of the tool, forming a hand support section for a hand of a user to push down the fin box engagement side against the fin box of the fin being removed/inserted.

In FIG. 5F the tool is shown in a front/fin box engagement side view. The tip/ending of the second, fin box engagement side, is shown in the figure. On the widening end sections of the edges of the external layers, the forward-facing bottom part of the non-slip material strips are shown to have jagged/zig-zagged edges—depicted by the multiple short parallel lines drawn across the edges—to improve their grip and/or cushioning when pressed against the fin box of a fin being removed or inserted. The space formed between the external layers, to accommodate/accept a fin being removed/inserted, is also indicated, wherein both, the bottom curved fin engagement element and the top curved fin engagement element—formed by the internal layer—are indicated and can be seen at the starting, far end, of the space.

The internal sides/surfaces of the outer layers, in this exemplary embodiment, are shown to include horizontal channels, which cross-sections are visible in the figure. The channel may lower the weight of the tool, improve the gripping of a fin being removed/inserted and/or facilitate the removal of fluids (e.g. sea water) remaining on the fin after watercraft usage.

Further shown, is the upward curving/bulging/protruding of the external layers at the top of the second, fin box engagement side, of the tool, forming a hand support section for a hand of a user to push down the fin box engagement side against the fin box of a fin being removed/inserted.

Figure 6A:
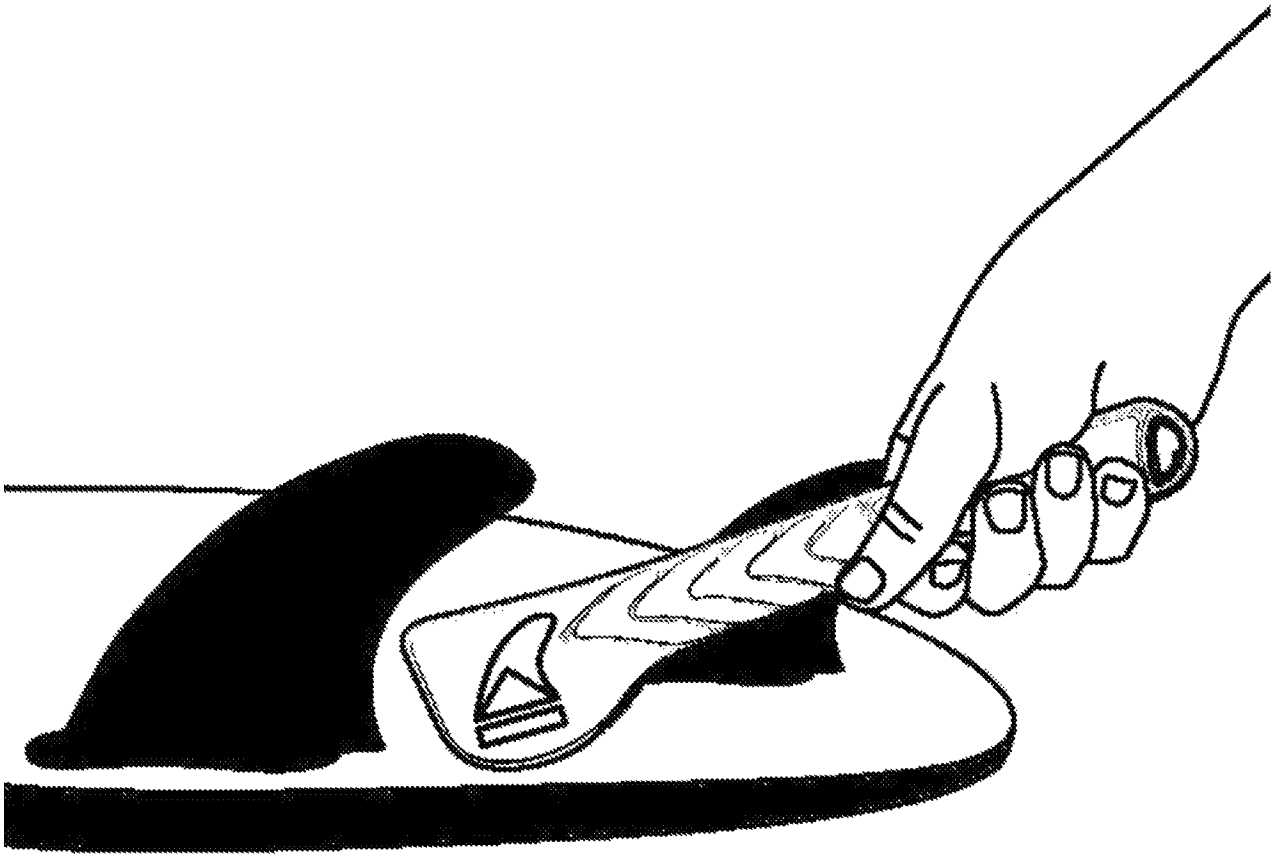
FIGS. 6A-6C are perspective view diagrams of the operation steps of an exemplary tool for watercraft fin insertion and removal, in accordance with some embodiments of the present invention, wherein the tool is being used for the removal of a surfboard fin of a first fin connection system.
Figure 6B:
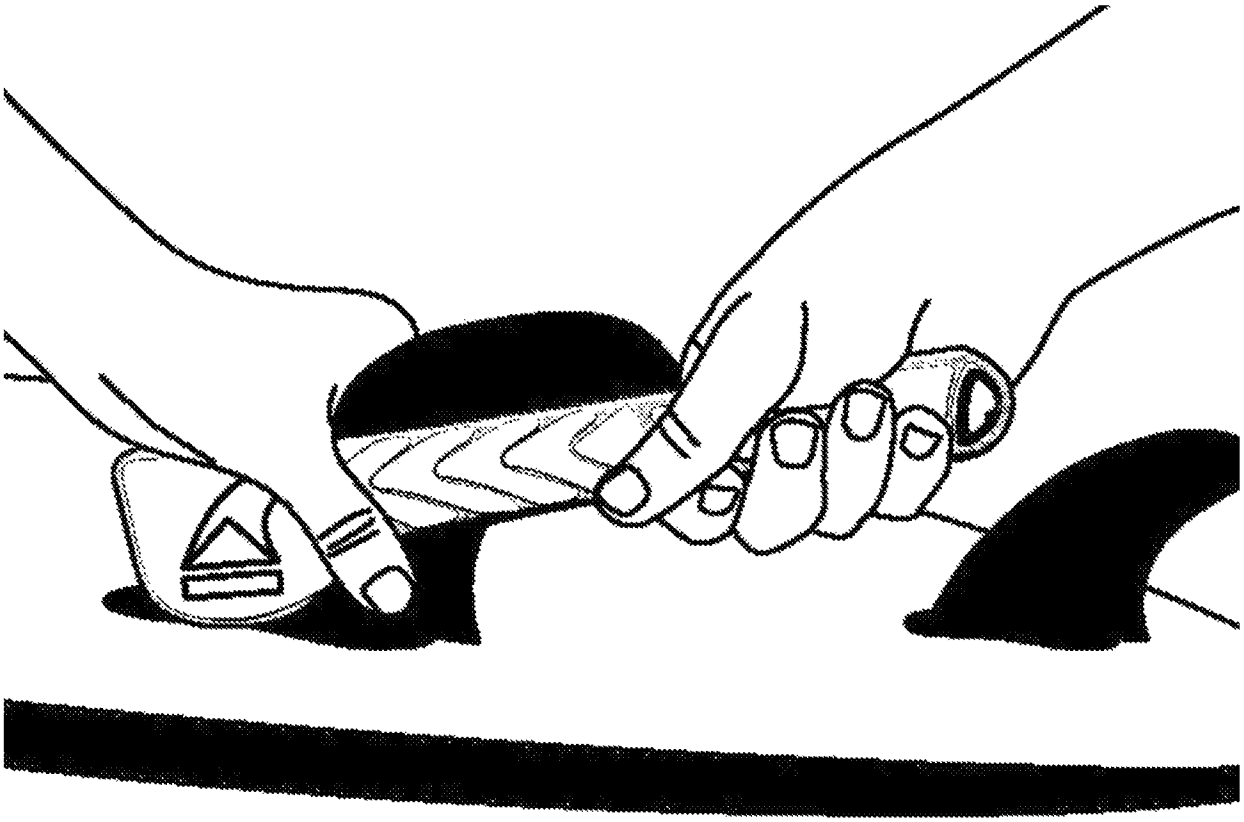
Figure 6C:
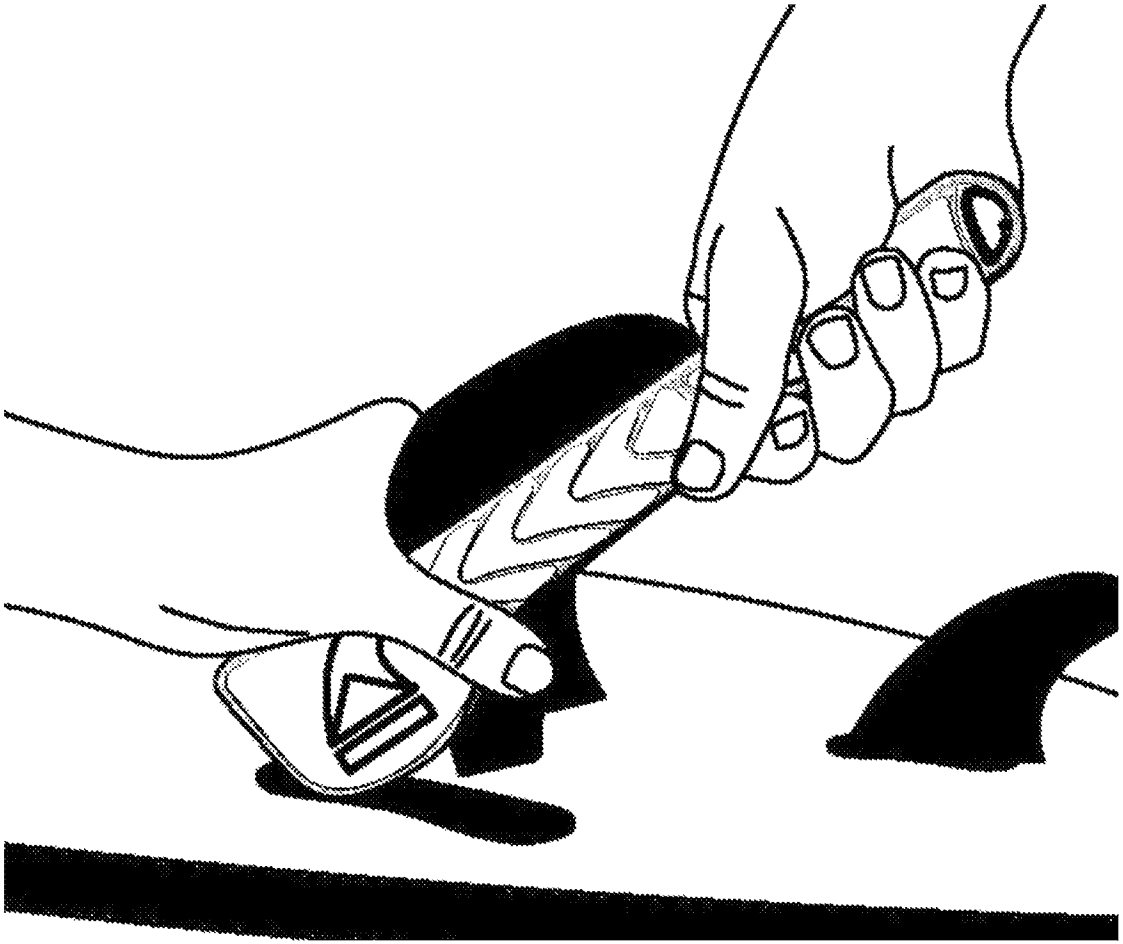

In FIGS. 6A-6C, there are shown, perspective view diagrams of the operation steps of an exemplary tool for watercraft fin insertion and removal, in accordance with some embodiments of the present invention, wherein the tool is being used for the removal of a surfboard fin of a first fin connection system.

In FIG. 6A the fin is shown to be positioned within its fin box, while the tool is positioned behind the fin. From this position the tool, held at its handle by the user, may be moved forward and over/onto the fin such that the inner surfaces of the external layers of the tool are-adjacent-to/partially-overlap the outside surfaces of the fin.

In FIG. 6B the fin is shown to be positioned within its fin box, while the tool is positioned over/on the fin such that the inner surfaces of the external layers of the tool are-adjacent-to/partially-overlap the outside surfaces of the fin. The leverage point/section/axis on the edge of the wide curved fin box engagement section of the tool is shown to be positioned-on/in-contact-with the fin box of the fin, while a top curved fin engagement element is in contact with trailing edge of the fin.

The first, handle side, of the tool is being held by the right hand of the user, while the second, fin box side, of the tool is being pressed down by the left hand of the user.

In FIG. 6C, as a result of the upward force applied by the right hand of the user and transferred to the fin by the top curved fin engagement element, the back, trailing edge side, of the fin is shown to rise and disconnect from the fin box. From this position, further upward force applied by the right hand of the user and the release of the pressing down by the left hand of the user, will cause the entire fin to rise and disconnect from the fin box.

Figure 7A:
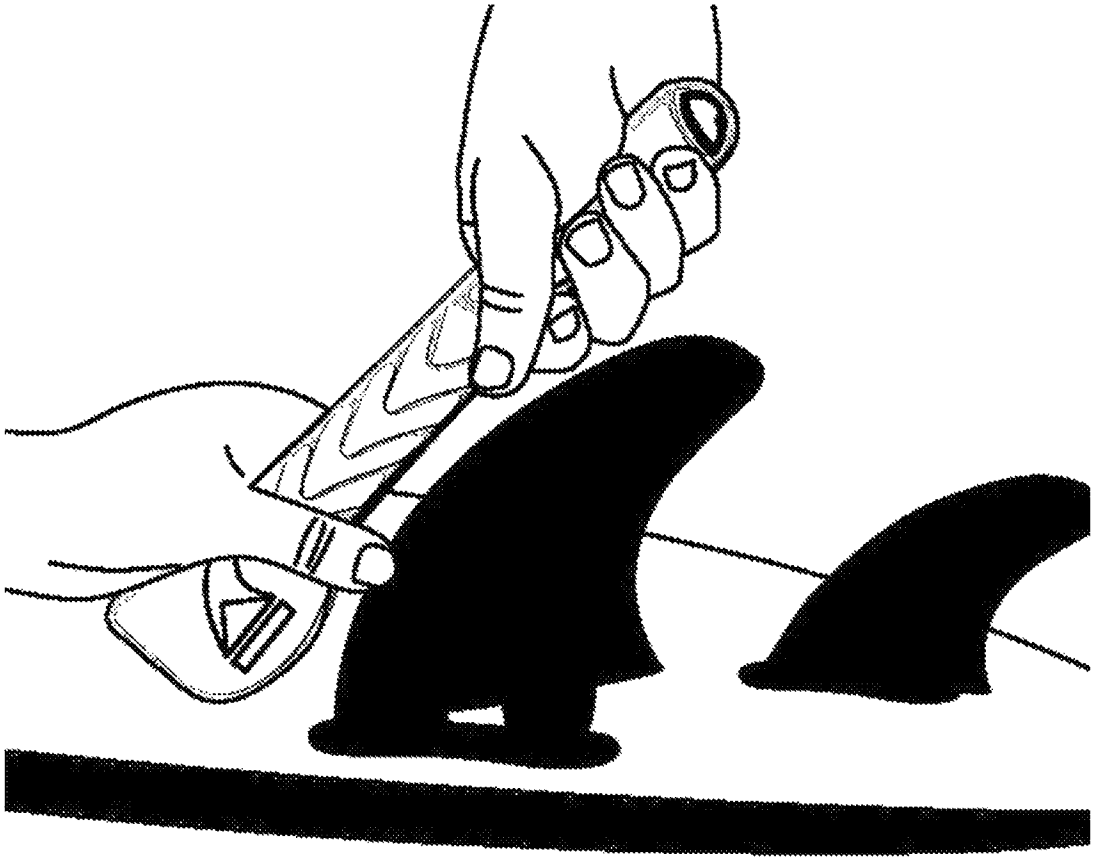
FIGS. 7A-7C are perspective view diagrams of the operation steps of an exemplary tool for watercraft fin insertion and removal, in accordance with some embodiments of the present invention, wherein the tool is being used for the insertion of a surfboard fin of a first fin connection system.
Figure 7B:
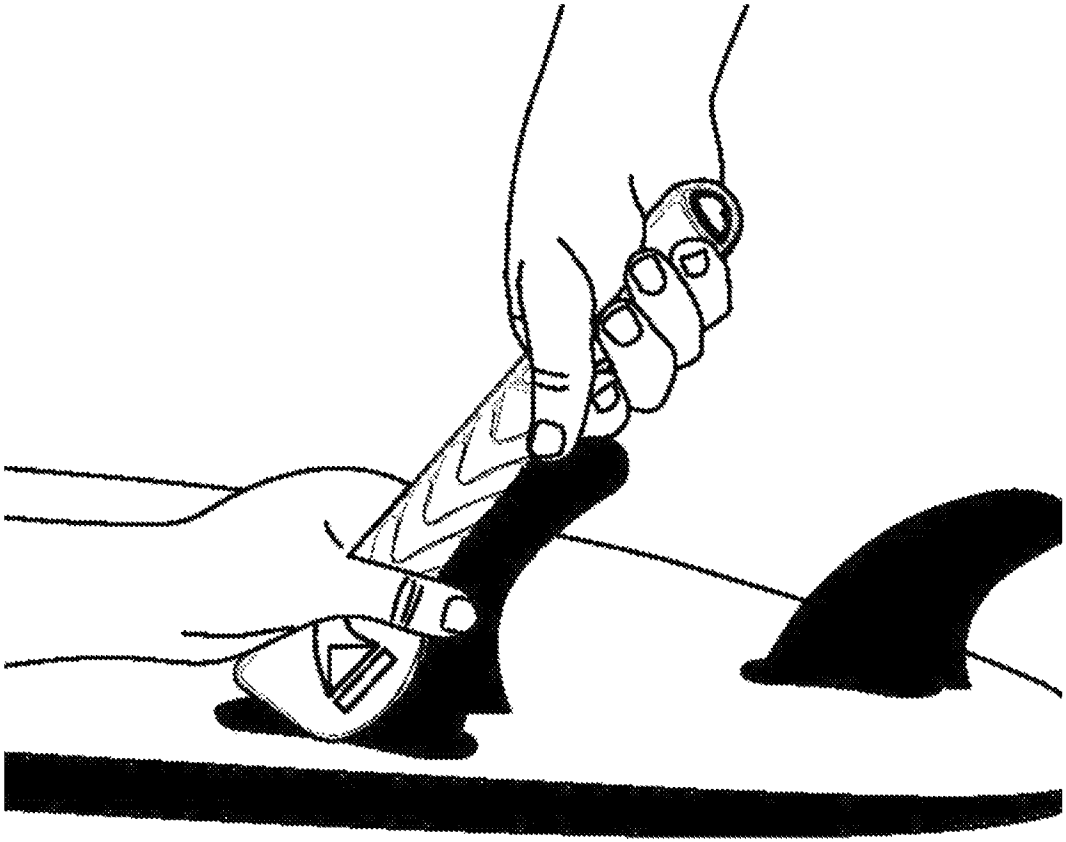
Figure 7C:
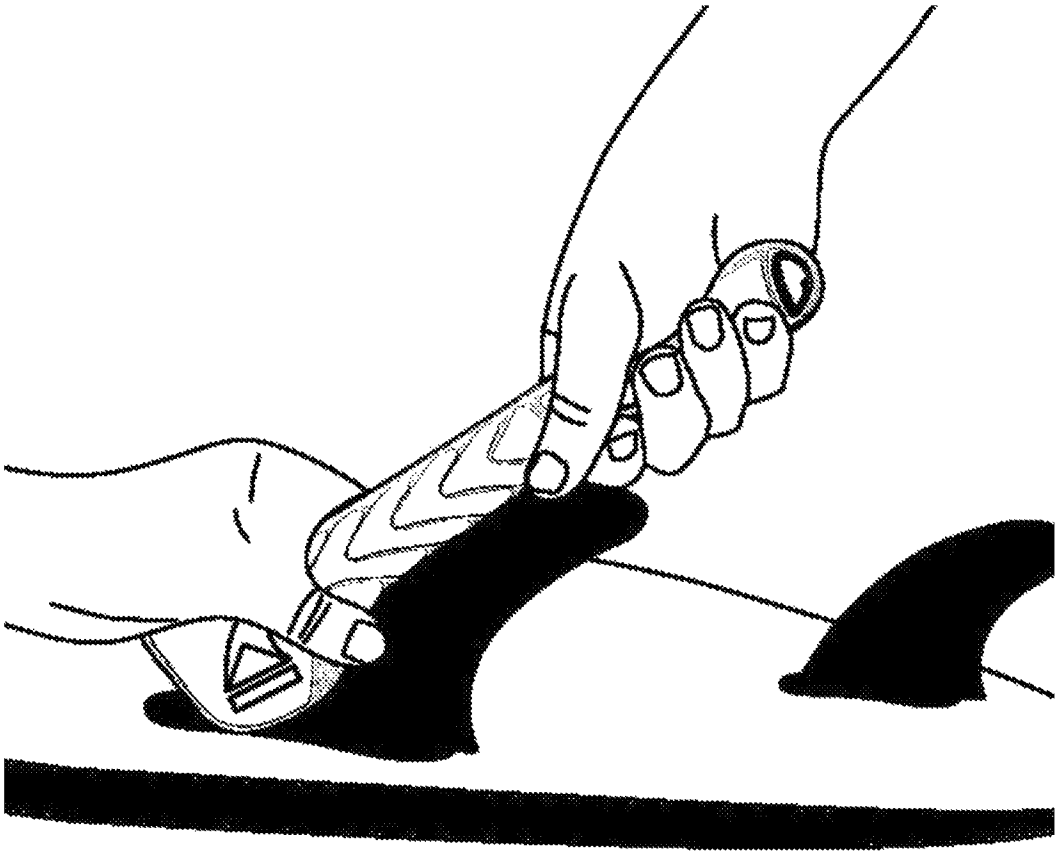

In FIGS. 7A-7C, there are shown, perspective view diagrams of the operation steps of an exemplary tool for watercraft fin insertion and removal, in accordance with some embodiments of the present invention, wherein the tool is being used for the insertion of a surfboard fin of a first fin connection system.

In FIG. 7A the fin is shown to be positioned such that the bottom of the front, leading edge side, of the fin is partially within its fin box, while the bottom of the back, trailing edge side, of the fin is completely out of its fin box. The tool is positioned in front of the fin. From this position the tool, held at its handle by the right hand of the user and at the top of its fin box engagement side by the left hand of the user (hands may swopped/switched, e.g. for a left handed user), may be moved backward and over/onto the fin such that the inner surfaces of the external layers of the tool are-adjacent-to/partially-overlap the outside surfaces of the fin.

In FIG. 7B the tool is positioned over/on the fin such that the inner surfaces of the external layers of the tool are-adjacent-to/partially-overlap the outside surfaces of the fin. The leverage point/section/axis on the edge of the wide curved fin box engagement section of the tool is shown to be positioned-on/in-contact-with the fin box of the fin, while a bottom curved fin engagement element is in contact with leading edge of the fin.

In FIG. 7C, as a result of downward force applied by the right hand of the user and transferred to the fin by the bottom curved fin engagement element—while the second, fin box side, of the tool is being pressed down by the left hand of the user—the back, trailing edge side, of the fin is shown to decline/lower and completely enter the fin box to its designated position/slot.

Figure 8A:
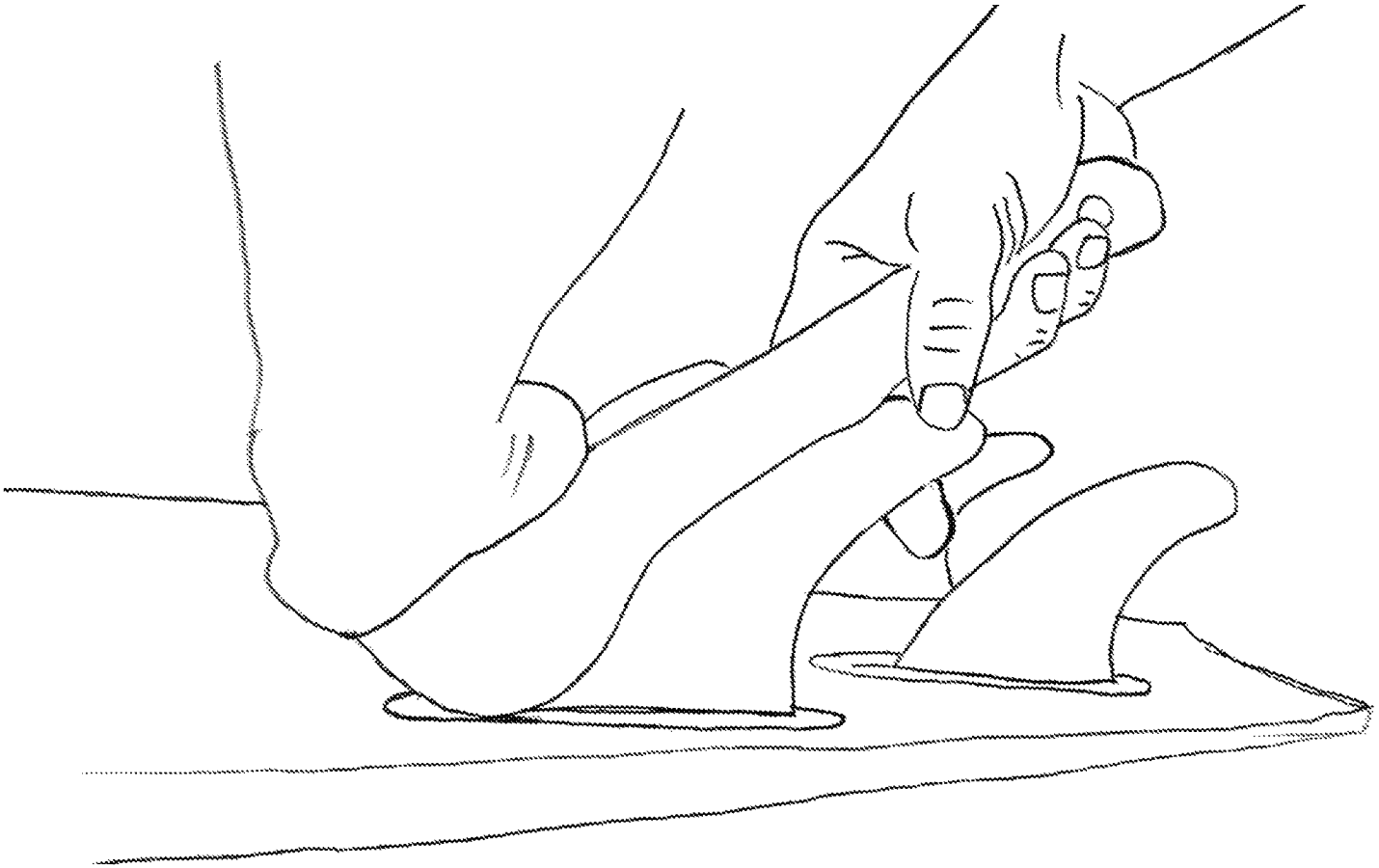
FIGS. 8A-8C are perspective view diagrams of the operation steps of an exemplary tool for watercraft fin insertion and removal, in accordance with some embodiments of the present invention, wherein the tool is being used for the removal of a surfboard fin of a second fin connection system.
Figure 8B:
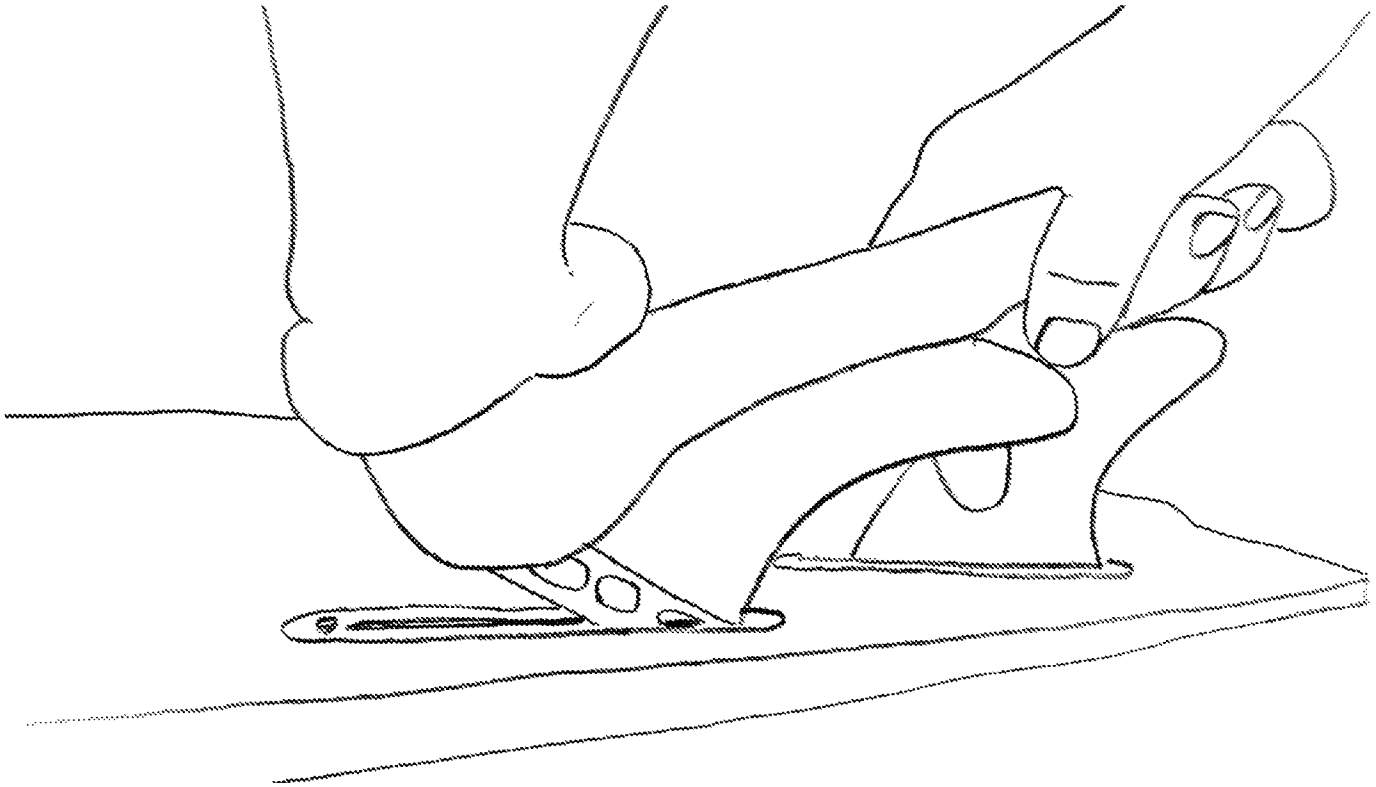
Figure 8C:
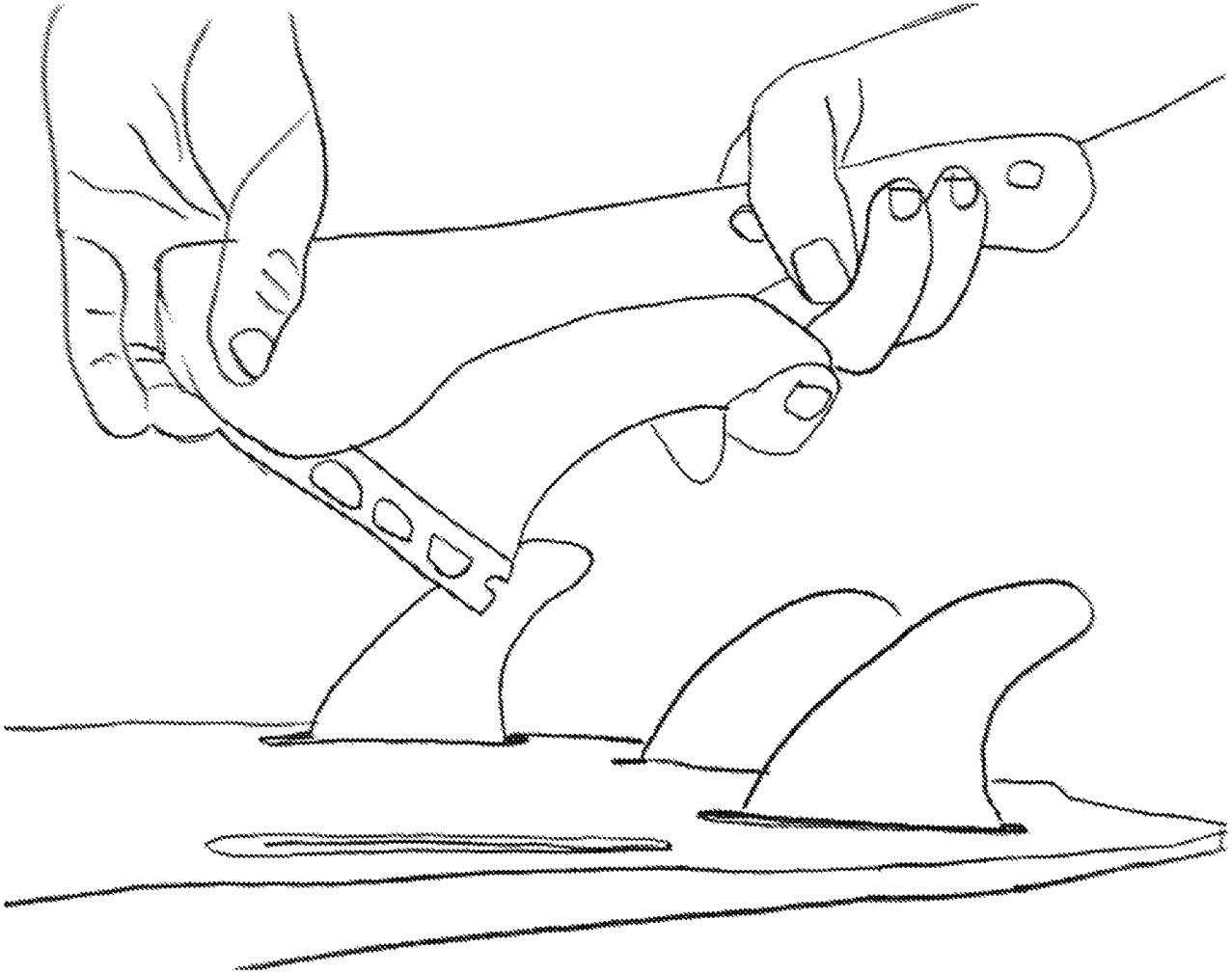

In FIGS. 8A-8C, there are shown, perspective view diagrams of the operation steps of an exemplary tool for watercraft fin insertion and removal, in accordance with some embodiments of the present invention, wherein the tool is being used for the removal of a surfboard fin of a second fin connection system.

In FIG. 8A the fin is shown to be positioned within its fin box, while the tool is positioned over/on the fin such that the inner surfaces of the external layers of the tool are-adjacent-to/partially-overlap the outside surfaces of the fin. The leverage point/section/axis on the edge of the wide curved fin box engagement section of the tool is shown to be positioned-on/in-contact-with the fin box of the fin, while a bottom curved fin engagement element is in contact with leading edge of the fin.

The first, handle side, of the tool is being held by the right hand of the user, while the second, fin box side, of the tool is being pressed down by the left hand of the user.

In FIG. 8B, as a result of the downward, or downward and backward, force applied by the right hand of the user and transferred to the fin by the bottom curved fin engagement element, the front, leading edge side, of the fin is shown to rise and disconnect from the fin box.

In FIG. 8C, as a result of further downward force applied by the right hand of the user; and the following upward force applied by the right hand of the user and the release of the pressing down by the left hand of the user, the entire fin is shown to rise and disconnect from the fin box.

Figure 9A:
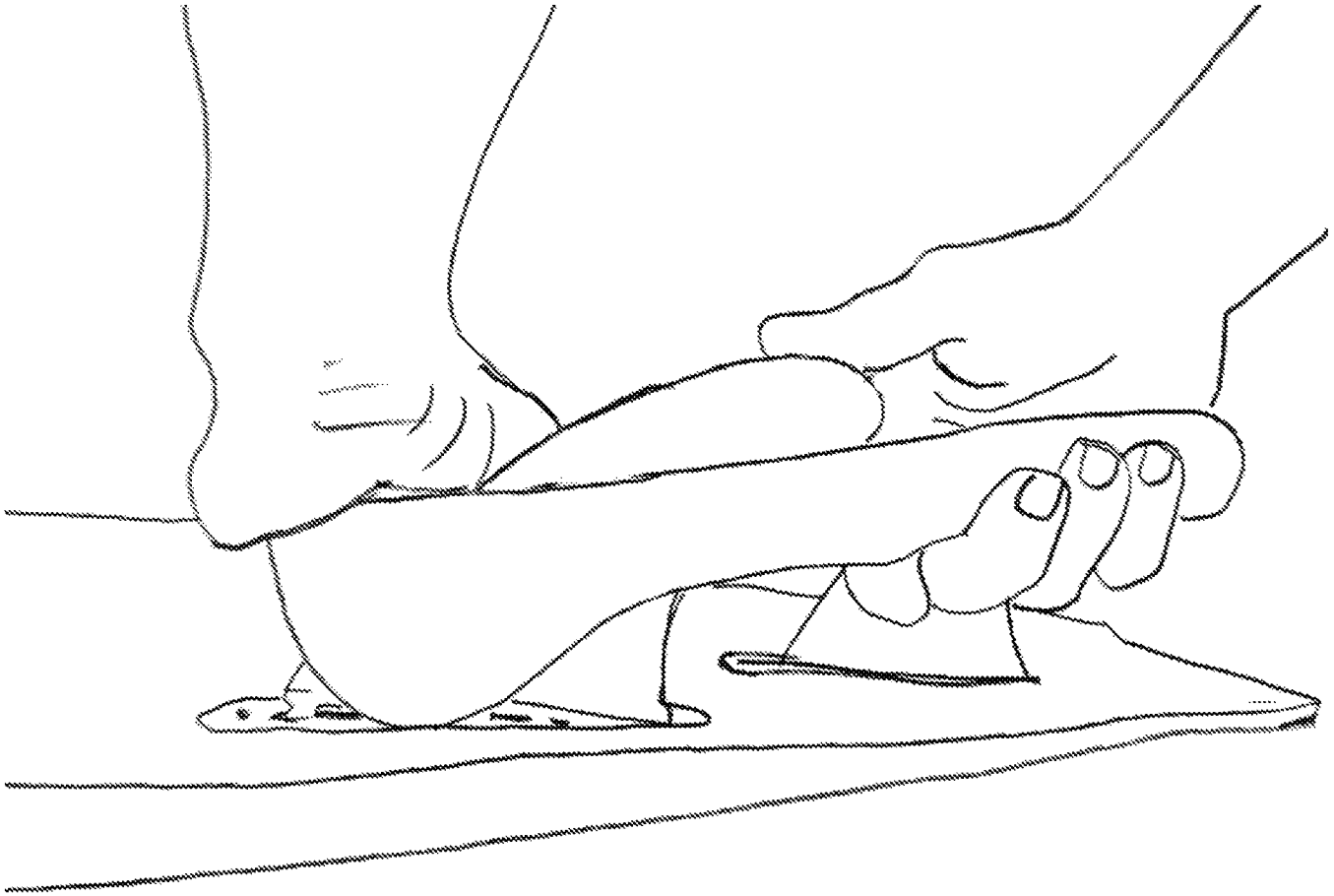
FIGS. 9A-9B are perspective view diagrams of the operation steps of an exemplary tool for watercraft fin insertion and removal, in accordance with some embodiments of the present invention, wherein the tool is being used for the insertion of a surfboard fin of a second fin connection system.
Figure 9B:
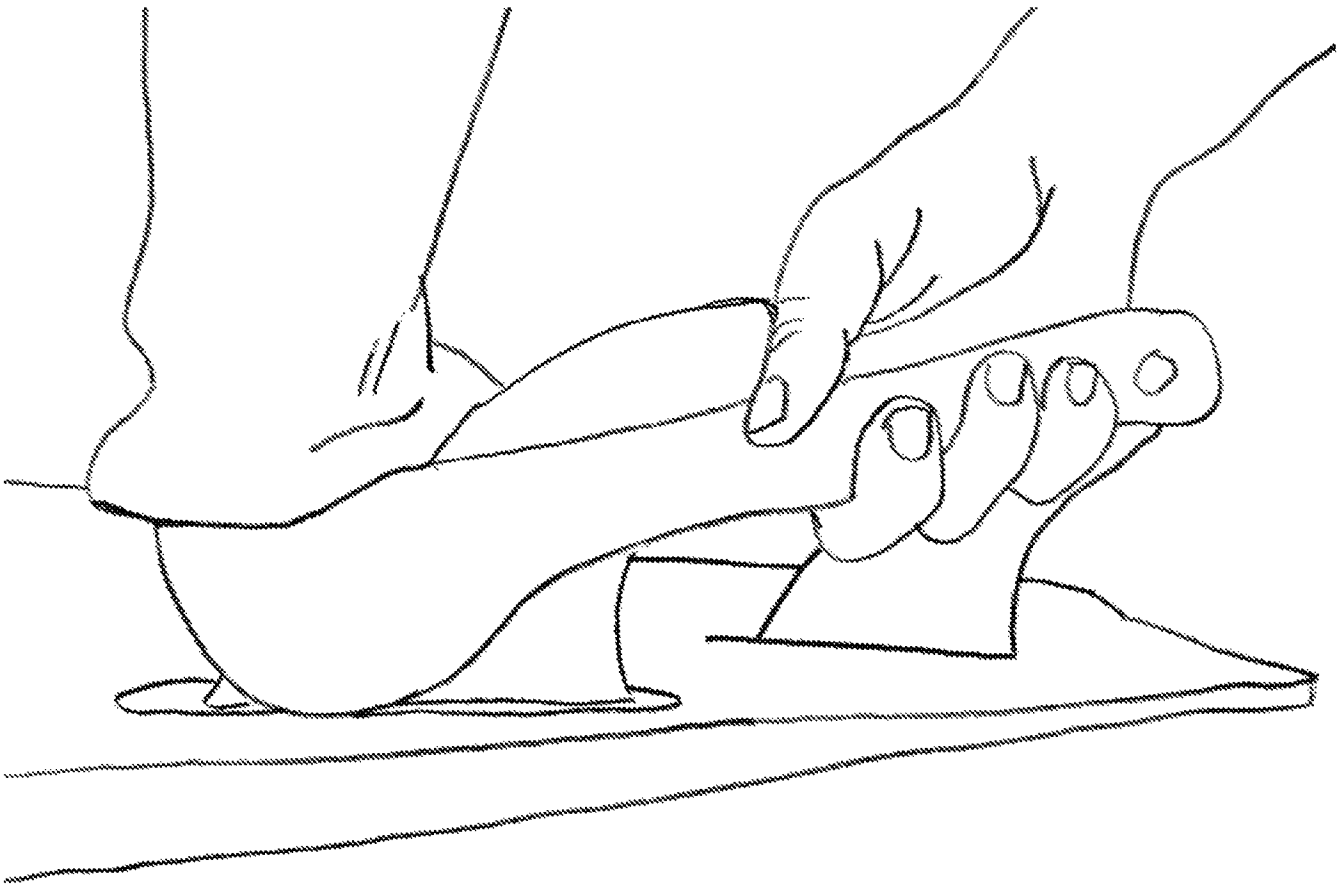

In FIGS. 9A-9B, there are shown, perspective view diagrams of the operation steps of an exemplary tool for watercraft fin insertion and removal, in accordance with some embodiments of the present invention, wherein the tool is being used for the insertion of a surfboard fin of a second fin connection system.

Initially the fin may be positioned by the user such that the bottom of the back, trailing edge side, of the fin is partially within its fin box, while the bottom of the front, leading edge side, of the fin is completely out of its fin box.

In FIG. 9A the tool is positioned over/on the fin such that the inner surfaces of the external layers of the tool are-adjacent-to/partially-overlap the outside surfaces of the fin. The leverage point/section/axis on the edge of the wide curved fin box engagement section of the tool is shown to be positioned-on/in-contact-with the fin box of the fin, while a top curved fin engagement element is in contact with trailing edge of the fin.

In FIG. 9B, as a result of upward, or upward and forward, force applied by the right hand of the user and transferred to the fin by the top curved fin engagement element—while the second, fin box side, of the tool is being pressed down by the left hand of the user—the front, leading edge side, of the fin is shown to decline/lower and completely enter the fin box to its designated position.

According to some embodiments, the fin insertion and removal tool may be produced/fabricated: as separate external layers and an internal layer, connected (e.g. glued, screwed, clipped) to each other; as a single molded unit; as a single unit curved/cut-out from a piece of material (e.g. by a router, by a drill); as a 3-dimensional printed unit or 3-dimensionally printed parts connected to each other; and/or by utilizing any other production/fabrication method or process, known today or to be devised in the future.

According to some embodiments of the present invention, a tool for watercraft fin insertion and removal may include a spacing element(s)—for example, in the form of a bolt or a relatively small material layer—for retaining the external layers of the tool at a designated distance between each other. The spacing element may, for example, be positioned at the ending/tip of the second side of the device, on the top edge of the wide curved fin box engagement section or in proximity thereto.

According to some embodiments of the present invention, a tool for watercraft fin insertion and removal may include one or more a spaces/holes/cut-outs—for example, in the first, handle side, of the tool—for decreasing the weight of the tool, for threading a holding/hanging strap or a rope to the tool and/or for saving on the amount of material used for producing the tool.

According to some embodiments of the present invention, a tool for watercraft fin insertion and removal may include: a first external elongated layer; a second external elongated layer, aligned with, and positioned at a substantially parallel plane to the plane of, the first external layer; and an internal layer positioned between, and stretching across a portion of the area of, the first layer and the second layer; wherein, upon positioning the tool such that the inner surface of the first external elongated layer is adjacent to the surface of one side of the watercraft fin and the inner surface of the second external elongated layer is adjacent to the surface of the other side of the watercraft fin, one of two curved fin engagement elements of the internal layer complements at least a portion of the leading edge or the trailing edge of the watercraft fin.

According to some embodiments, the internal layer may stretch across the area of a first of two sides of the tool; and the curved fin engagement elements of the internal layer, may be located along the ending line of the first side.

According to some embodiments, a bottom long edge of the tool, may widen towards the tip of the second side of the tool, to form a wide curved fin box engagement section; such that upon positioning one of the curved fin engagement elements of the internal layer on the leading edge or the trailing edge of the watercraft fin, the edge of the wide curved fin box engagement section comes in contact with the bottom surface of the watercraft or a fin box integrated thereto.

According to some embodiments, at least a section of the first side of the tool may be shaped as a handle, having its bottom long edge, or part thereof, shaped to accommodate the fingers of a user's hand.

According to some embodiments, at least a section of the second side of the tool is shaped as a palm support, having its top long edge, or part thereof, shaped to accommodate the palm of a user.

According to some embodiments, the curved fin engagement elements of the internal layer may include: a first curved fin engagement element—closer to, and forming a sharp angle with, a top long edge of the tool—complementing at least a portion of the trailing edge of the watercraft fin; and, a second curved fin engagement element—closer to, and forming a sharp angle with, a bottom long edge of the tool—complementing at least a portion of the leading edge of the watercraft fin.

According to some embodiments, at least a portion of the edge, of the wide curved fin box engagement section that comes in contact with the bottom surface of the watercraft or a fin box integrated thereto, may be covered with a non-slip material.

According to some embodiments, the edge of the non-slip material may be jagged.

According to some embodiments, the curved fin engagement elements of the internal layer may be covered with a non-slip material.

According to some embodiments, on the second side of the tool, at least a portion of the inner surface of the first external elongated layer and at least a portion of the inner surface of the second external elongated layer may be covered with a non-slip material.

According to some embodiments, the first external elongated layer, the second external elongated layer and the internal layer may be separately formed and may be connected to each other to form the tool.

According to some embodiments, the first external elongated layer, the second external elongated layer and the internal layer may be connected to each other by an adhesive material or by screws and bolts.

According to some embodiments, the first external elongated layer, the second external elongated layer and the internal layer—may be cut from within a sheet or platter of the same material.

According to some embodiments, the first external elongated layer, the second external elongated layer and the internal layer—may be collectively molded to form the shape of the tool.

According to some embodiments, the first external elongated layer, the second external elongated layer and the internal layer—may be collectively shaped out of a single block of material by a router to form the shape of the tool.

According to some embodiments, the first external elongated layer, the second external elongated layer and the internal layer—may be collectively shaped out by a 3-dimensional printer to form the shape of the tool.

According to some embodiments of the present invention, a method for watercraft fin removal using a fin insertion and removal tool, may include: positioning the inner surfaces of two external layers of the tool adjacent to the outer surfaces of the watercraft fin; positioning a curved fin engagement element of an internal layer of the tool on the trailing edge of the watercraft fin; positioning the edge of a wide curved fin box engagement section of the tool in contact with the bottom surface of the watercraft or a fin box, of the inserted fin, integrated thereto; applying downward force, towards the bottom of the water craft, on the top edge of the wide curved fin box engagement section of the tool; and applying upward force, away from the bottom of the water craft, on the side of the tool, which is opposite to the side of the wide curved fin box engagement section—causing the curved fin engagement element of the internal layer to press against and apply upward and forward force on the trailing edge of the fin, thus releasing it from out of the bottom surface of the watercraft or a fin box, of the inserted fin, integrated thereto.

According to some embodiments of the present invention, a method for watercraft fin insertion using a fin insertion and removal tool, may include: positioning the inner surfaces of two external layers of the tool adjacent to the outer surfaces of the watercraft fin; positioning a curved fin engagement element of an internal layer of the tool on the leading edge of the watercraft fin; positioning the edge of a wide curved fin box engagement section of the tool in contact with the bottom surface of the watercraft or a fin box, of the inserted fin, integrated thereto; applying downward force, towards the bottom of the water craft, on the top edge of the wide curved fin box engagement section of the tool; and applying downward force, towards the bottom of the water craft, on the side of the tool, which is opposite to the side of the wide curved fin box engagement section—causing the curved fin engagement element of the internal layer to press against and apply downward and backward force on the leading edge of the fin thus inserting it into the bottom surface of the watercraft or a fin box, of the inserted fin, integrated thereto.

The subject matter described above is provided by way of illustration only and should not be constructed as limiting. While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. A tool for watercraft fin removal, said tool including:

a first external elongated layer;

a second external elongated layer, aligned with, and positioned at a substantially parallel plane to the plane of, said first external layer;

an internal layer positioned between, and stretching across a portion of the area of, said first layer and said second layer; and wherein, upon positioning the tool such that a curved fin engagement element of said internal layer complements a portion of the trailing edge of the watercraft fin, a fin box engagement section of said first and second external layers comes in contact with the fin box of the watercraft fin, acting as a lever fulcrum of said tool when said tool is forced upwards and against the trailing edge of the watercraft fin.

2. The tool according to claim 1, wherein said internal layer stretches across the area of a first of two sides of said tool; and wherein said curved fin engagement element of said internal layer, is located along the ending line of the first side.

3. The tool according to claim 2, wherein at least a section of the first side of said tool is shaped as a handle, having its bottom long edge, or part thereof, shaped to accommodate the fingers of a user's hand.

4. The tool according to claim 3, wherein at least a section of the second side of said tool is shaped as a palm support, having its top long edge, or part thereof, shaped to accommodate the palm of a user.

5. The tool according to claim 2, wherein said internal layer includes: said curved fin engagement element—positioned closer to, and forming a sharp angle with, a top long edge of said tool—complementing at least a portion of the trailing edge of the watercraft fin; and, a second curved fin engagement element positioned closer to, and forming a sharp angle with, a bottom long edge of said tool—complementing at least a portion of the leading edge of the watercraft fin.

6. The tool according to claim 1, wherein at least a portion of the edge, of said fin box engagement section is covered with a non-slip material.

7. The tool according to claim 6, wherein the edge of said non-slip material is jagged.

8. The tool according to claim 1, wherein said curved fin engagement element of said internal layer is covered with a non-slip material.

9. The tool according to claim 8, wherein on the second side of said tool, at least a portion of the inner surface of said first external elongated layer and at least a portion of the inner surface of said second external elongated layer are covered with a non-slip material.

10. The tool according to claim 1, wherein said first external elongated layer, said second external elongated layer and said internal layer are separately formed and are connected to each other to form said tool.

11. The tool according to claim 10, wherein said first external elongated layer, said second external elongated layer and said internal layer are connected to each other by an adhesive material or by screws and bolts.

12. The tool according to claim 10, wherein said first external elongated layer, said second external elongated layer and said internal layer—are cut from within a sheet or platter of the same material.

13. The tool according to claim 1, wherein said first external elongated layer, said second external elongated layer and said internal layer—are collectively molded to form the shape of said tool.

14. The tool according to claim 1, wherein said first external elongated layer, said second external elongated layer and said internal layer—are collectively shaped out of a single block of material by a router to form the shape of said tool.

15. The tool according to claim 1, wherein said first external elongated layer, said second external elongated layer and said internal layer—are collectively shaped out by a 3-dimensional printer to form the shape of said tool.

* * * * *